US010300703B2

(12) United States Patent
Okumura et al.

(10) Patent No.: US 10,300,703 B2
(45) Date of Patent: May 28, 2019

(54) PRINTER WITH A PRINTING HEAD FOR EJECTING INK

(71) Applicant: SEIKO EPSON CORPORATION, Tokyo (JP)

(72) Inventors: Hideki Okumura, Shiojiri (JP); Naomi Kimura, Okaya (JP); Shoma Kudo, Shiojiri (JP); Motoyoshi Shirotori, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/905,128

(22) Filed: Feb. 26, 2018

(65) Prior Publication Data

US 2018/0244063 A1 Aug. 30, 2018

(30) Foreign Application Priority Data

Feb. 28, 2017 (JP) ..... 2017-035976

(51) Int. Cl.

| | |
|---|---|
| ***B41J 2/175*** | (2006.01) |
| ***B41J 2/165*** | (2006.01) |
| ***B41J 29/13*** | (2006.01) |
| ***B41J 29/02*** | (2006.01) |

(52) U.S. Cl.

CPC ..... *B41J 2/17553* (2013.01); *B41J 2/16508* (2013.01); *B41J 2/16517* (2013.01); *B41J 2/1752* (2013.01); *B41J 2/1754* (2013.01); *B41J 2/17509* (2013.01); *B41J 29/02* (2013.01); *B41J 29/13* (2013.01)

(58) Field of Classification Search

CPC .. B41J 2/17553; B41J 2/16508; B41J 2/1752; B41J 2/1754; B41J 2/17523; B41J 2/175; B41J 2/17509; B41J 2/17566; B41J 2/17506; B41J 29/02; B41J 29/13; B41J 2/16505; B41J 2/16517

USPC ..... 347/7, 29, 32, 84, 85

See application file for complete search history.

(56) References Cited

U.S. PATENT DOCUMENTS

2008/0297571 A1* 12/2008 Umeda ..... B41J 2/17509 347/85
2015/0283815 A1* 10/2015 Igarashi ..... B41J 2/175 347/85
2017/0043586 A1* 2/2017 Yanagida ..... B41J 2/175
2017/0120617 A1* 5/2017 Matsumura ..... B41J 2/17509

FOREIGN PATENT DOCUMENTS

JP 2008-296508 A 12/2008

* cited by examiner

*Primary Examiner* — Jannelle M Lebron
(74) *Attorney, Agent, or Firm* — Foley & Lardner LLP

(57) ABSTRACT

Provided is a printer wherein ink can be easily injected and filled into a tank. A printer including: a printing head; a housing; a body cover shiftable between a closed state of closing an opening of the housing and an open state of exposing the opening; a tank including an ink container and an ink inlet port receiving the ink injection into the ink container; and a tank cover shiftable between a closed state of closing the ink inlet port and an open state of exposing the ink inlet port. The body cover in the closed state covers a portion of the tank cover, and the ink inlet port is located outside a region of the body cover. The tank cover changes from the closed state to the open state, triggered by the body cover changing from the closed state to the open state.

12 Claims, 17 Drawing Sheets

PRINTER WITH A PRINTING HEAD FOR EJECTING INK

BACKGROUND

1. Technical Field

The present invention relates to printers and the like.

2. Related Art

Examples of hitherto known printers include inkjet printers capable of printing on a recording medium, such as recording paper, using ink by discharging the ink from a recording head onto the recording medium. Some inkjet printers allow a user to refill a tank for storing ink that is to be supplied to the recording head. Also, some hitherto known inkjet printers are provided with a tank at a position that is to be covered by an image reading portion that is pivotably opened and closed relative to an image forming portion that performs printing (refer to JP-A-2008-296508, for example).

In a printer described in JP-A-2008-296508, a refilling port of the tank is exposed when the image reading portion is opened relative to the image forming portion. Accordingly, the tank can be refilled with ink from the refilling port. However, even in a state in which the image reading portion is opened relative to the image forming portion, the image reading portion is likely to extend above the refilling port in the manner of a hood. Therefore, in the printer described in JP-A-2008-296508, there is a problem in that it is not easy to inject ink into the tank.

SUMMARY

An advantage of some aspects of the invention is that ink can be easily injected into a tank in a printer.

The invention is realized as the following embodiments and application examples.

Application Example 1

A printer including: a printing head configured to eject ink; a housing that houses the printing head; a body cover configured to be shifted between a closed state of closing an opening formed in the housing and an open state of exposing the opening; a tank including an ink container configured to contain the ink to be supplied to the printing head, and an ink inlet port through which the ink can be injected into the ink container; and a tank cover configured to be shifted between a closed state of closing the ink inlet port and an open state of exposing the ink inlet port. When the body cover in the closed state is viewed in plan view in a posture in which the printing head is used, the body cover covers a portion of the tank cover, and the ink inlet port is located outside a region of the body cover. The tank cover changes from the closed state to the open state, triggered by the body cover changing from the closed state to the open state.

In this printer, the ink inlet port of the tank is located outside the region of the body cover in plan view. Therefore, blockage of the ink inlet port by the body cover can be easily avoided. Also, in this printer, the tank cover that covers the ink inlet port changes from a closed state to an open state, triggered by the body cover changing from a closed state to an open state. Accordingly, the tank cover can be opened when the body cover is opened. As a result, a printer in which ink can be easily injected into a tank through an ink inlet port can be provided.

Application Example 2

The printer described above, wherein the tank cover includes a cap member connected therewith. The cap member closes off the ink inlet port when the tank cover is in a closed state, and exposes the ink inlet port when the tank cover is in the open state.

In this printer, since the tank cover includes the cap member connected therewith, the ink inlet port can be opened and closed according to the opening and closing of the tank cover.

Application Example 3

The printer described above, further including a cap member configured to be attached to and detached from the ink inlet port. The cap member is configured to be switchable between a close off state of closing off the ink inlet port in a state of being attached to the ink inlet port and an open state of exposing the ink inlet port in a state of being removed from the ink inlet port. The opening and closing of the tank cover and the attachment and detachment of the cap member relative to the ink inlet port are independent from each other.

In this printer, the opening and closing of the tank cover and the attachment and detachment of the cap member relative to the ink inlet port are independent from each other. Accordingly, even if the tank cover is opened, the state in which the cap member is attached to the ink inlet port can be maintained. Therefore, a case in which the ink inlet port is unintentionally opened when the body cover is opened to perform maintenance on the printing head can be easily avoided, for example. As a result, the occurrence of problems such as contaminants intruding into the ink inlet port and ink leaking out from the ink inlet port due to a change in orientation of the printer can be suppressed.

Application Example 4

The printer described above, wherein the state of the body cover is changed from the closed state to the open state as a result of the orientation relative to the housing being changed through pivoting thereof.

In this printer, the body cover can be changed from the closed state to the open state by pivoting.

Application Example 5

The printer described above, wherein the state of the body cover is changed from the closed state to the open state as a result of the position relative to the housing being changed through sliding thereof.

In this printer, the body cover can be changed from the closed state to the open state by sliding.

Application Example 6

The printer described above, wherein the tank cover is changed from the closed state to the open state as a result of the orientation relative to the tank being changed through pivoting thereof, further including a link mechanism that transfers movement of the body cover to the tank cover.

In this printer, the body cover and the tank cover are changed from a closed state to an open state by pivoting. Also, the printer includes the link mechanism that transfers movement of the body cover to the tank cover. Therefore, when the body cover is changed from a closed state to an open state, since the movement of the body cover is transferred to the tank cover via the link mechanism, the tank cover can be changed from the closed state to the open state.

Application Example 7

The printer described above, wherein the tank cover is changed from the closed state to the open state as a result that the orientation relative to the tank is changed through pivoting thereof, and that the tank cover is biased toward the open state in an orientation in the closed state, and the tank cover is locked by the body cover when the tank cover is in the closed state and the body cover is in the closed state, and the locking of the tank cover by the body cover is released when the body cover is changed to the open state.

In this printer, the tank cover that changes from the closed state to the open state by pivoting is biased toward the open state in a posture of the closed state. The tank cover is locked by the body cover when the tank cover is in the closed state and the body cover is in the closed state. Accordingly, the tank cover is kept in the closed state. When the body cover is changed to the open state and the locking of the tank cover by the body cover is released, the tank cover, which is biased toward the open state, changes to the open state. Therefore, when the body cover is changed from the closed state to the open state, the tank cover can change from the closed state to the open state.

Application Example 8

The printer described above, further including a biasing member that biases the tank cover toward the open state.

Since this printer includes the biasing member that biases the tank cover toward the open state, the tank cover can be easily changed from the closed state to the open state.

Application Example 9

The printer described above, further including an actuator that causes the tank cover to change from the closed state to the open state.

In this printer, the tank cover can be changed from a closed state to an open state by the actuator.

Application Example 10

The printer described above, wherein the tank cover changes from the closed state to the open state as a result of the position of the tank cover relative to the tank being changed through sliding thereof.

In this printer, since the body cover and the tank cover are changed from the closed state to the open state through sliding, the tank cover can be easily changed from the closed state to the open state when the body cover is changed from the closed state to the open state.

Application Example 11

A printer including: a printing head configured to eject ink; a housing that houses the printing head; a body cover configured to be shifted between a closed state of closing an opening formed in the housing and an open state of exposing the opening; a tank including an ink container configured to contain the ink to be supplied to the printing head and an ink inlet port through which the ink can be injected into the ink container; a tank cover configured to be shifted between a closed state of closing the ink inlet port and an open state of exposing the ink inlet port; and a cap member configured to be attached to and detached from the ink inlet port. The cap member is configured to be switchable between a close off state of closing off the ink inlet port in a state of being attached to the ink inlet port and an open state of exposing the ink inlet port in a state of being removed from the ink inlet port. When the body cover in the closed state is viewed in plan view in a posture in which the printing head is used, the body cover covers a portion of the tank cover, and the ink inlet port is located outside a region of the body cover. The cap member changes from the close off state to the open state, triggered by the tank cover changing from the closed state to the open state.

In this printer, the ink inlet port of the tank is located outside the region of the body cover in plan view. Therefore, blockage of the ink inlet port by the body cover can be easily avoided. Also, in this printer, the cap member that closes off the ink inlet port changes from the close off state to the open state, triggered by the tank cover changing from the closed state to the open state. Accordingly, when the tank cover is opened, the ink inlet port can be exposed. As a result, a printer in which ink can be easily injected into the tank through the ink inlet port can be provided.

Application Example 12

A printer, in the printer described above, wherein the tank cover is changed from the closed state to the open state through pivoting thereof.

In this printer, the tank cover can be changed from the closed state to the open state by pivoting.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
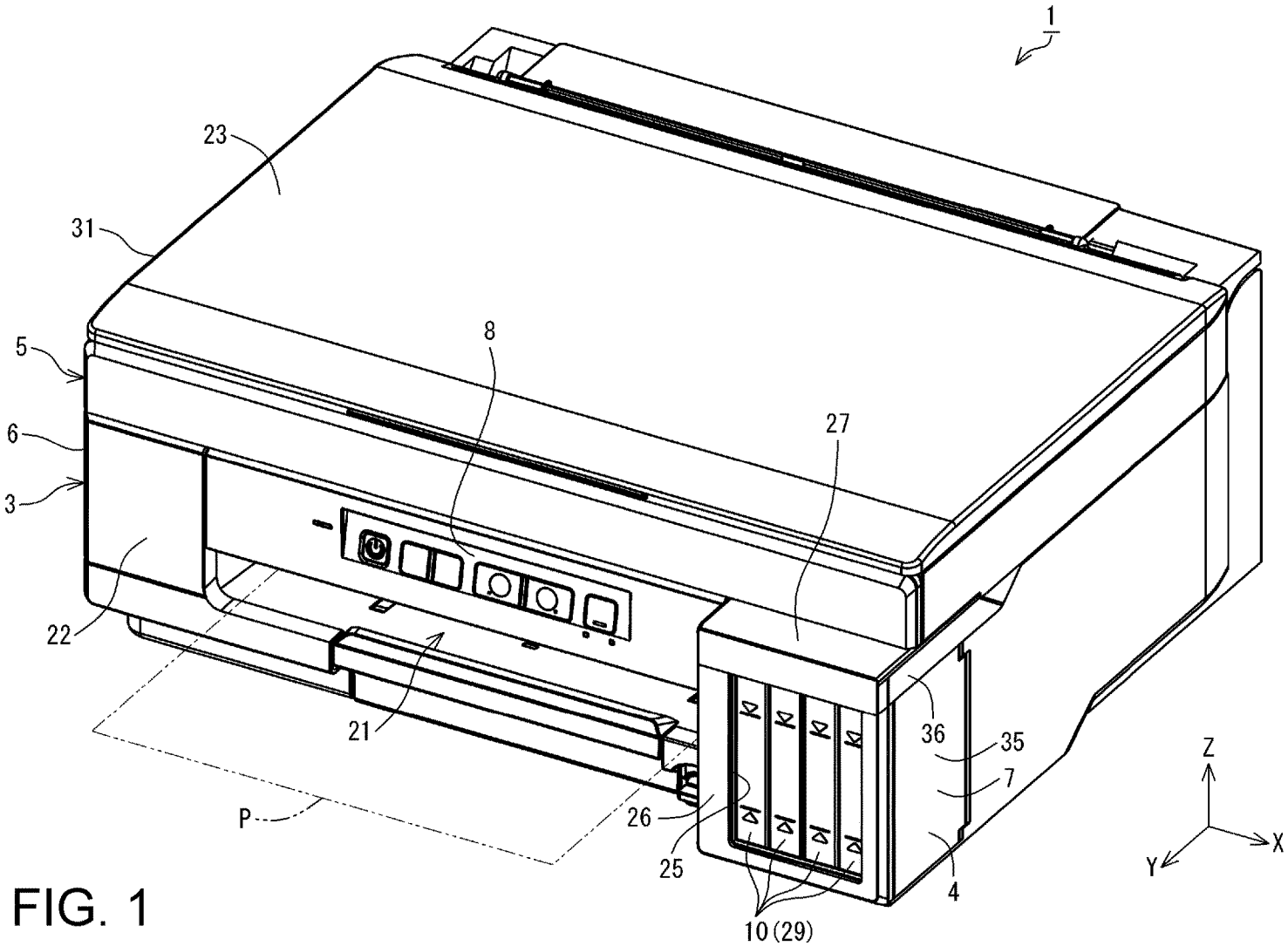
FIG. 1 is a perspective view illustrating a main configuration of a printer in a present embodiment.

An embodiment will be described with reference to the drawings. Note that, in the drawings, the scale of constituent parts and members may be different such that the respective constituent parts are shown with a recognizable size.

A printer 1 in the present embodiment includes a printing unit 3, which is an example of a liquid ejection device, a tank unit 4 provided next to the printing unit 3, and a scanner unit 5, as shown in FIG. 1. The printing unit 3 includes a housing 6. The housing 6 constitutes an outer shell of the printing unit 3. A mechanism unit (described later) of the printing unit 3 is housed inside the housing 6. The tank unit 4 includes a housing 7 and a plurality of (two or more) tanks 10. The plurality of tanks 10 are housed in the housing 7. Accordingly, the plurality of tanks 10 are provided next to the printing unit 3. Note that, four tanks 10 are provided in the present embodiment. The housing 6, the housing 7, and the scanner unit 5 constitute the outer shell of the printer 1. Note that a configuration in which the scanner unit 5 is omitted can be adopted as the printer 1. The printer 1 can perform printing on a printing medium P such as printing paper with ink, which is an example of liquid. The printing medium P is an example of a medium on which printing is performed. Note that the tank 10 is an example of a liquid container. Note that the housing 6 includes a panel 8. A power button, an operation button, a display device, and the like are arranged in the panel 8.

Here, X, Y, and Z axes, which are coordinate axes that are orthogonal to each other, are provided in FIG. 1. The X, Y, and Z axes are also provided as required in the subsequent drawings. In this case, the X, Y, and Z axes in each diagram correspond respectively to the X, Y, and Z axes in FIG. 1. FIG. 1 shows a state where the printer 1 is arranged on an XY plane defined by the X axis and the Y axis. In this embodiment, the state where the printer 1 is arranged on the XY plane with the XY plane being matched to a horizontal plane is a use state of the printer 1. The posture of the printer 1 when the printer 1 is arranged on the XY plane that matches a horizontal plane will be referred to as a use posture of the printer 1.

Hereinafter, the X axis, Y axis, and Z axis that appear in the drawings and descriptions depicting constituent parts and units of the printer 1 mean the X axis, Y axis, and Z axis in a state in which the constituent parts and units are assembled in (mounted in) the printer 1. The posture of the constituent parts and units when the printer 1 is in the use state will be referred to as a use posture of these constituent parts and units. In the following description, the printer 1, the constituent parts and units thereof, and the like are described as being in their use posture, unless otherwise stated.

The Z axis is an axis perpendicular to the XY plane. When the printer 1 is in the use state, the Z axis direction is a vertically upward direction. Also, when the printer 1 is in the use state, the −Z axis direction is a vertically downward direction in FIG. 1. Note that, regarding the X, Y, and Z axes, the arrow orientation indicates a plus (positive) direction, and the orientation opposite to the arrow orientation indicates a minus (negative) direction. Note that the four tanks 10 described above are arranged side by side along the X axis. Therefore, the X axis direction can also be defined as the direction in which the four tanks 10 are arranged. Also, the vertically upward direction and vertically upward indicate an upward direction and upward along a vertical line. Similarly, the vertically downward direction and vertically downward indicate a downward direction and downward along a vertical line. The upward direction and upward without mentioning "vertically" are not limited to an upward direction and upward along a vertical line, and include an upward direction and upward along a direction that intersects the vertical line except for the horizontal direction. Also, the downward direction and downward without mentioning "vertically" are not limited to a downward direction and downward along a vertical line, and include a downward direction and downward along a direction that intersects the vertical line except for the horizontal direction. That is, the upward direction and upward indicate a direction that includes a component in the vertically upward direction among directions that intersect the vertical line. Similarly, the downward direction and downward indicate a direction that includes a component in the vertically downward direction among directions that intersect the vertical line.

The printing unit 3 is provided with a paper discharge unit 21. In the printing unit 3, a printing medium P is discharged from the paper discharge unit 21. In the printing unit 3, the face in which the paper discharge unit 21 is provided is a front face 22. Note that a panel 8 is arranged in the front face 22, in the printer 1. The panel 8 faces in the same direction as the front face 22 (Y axis direction, in the present embodiment). The front face 22 of the printing unit 3 and the front face 22 of the scanner unit 5 are located on the same flat plane. That is, the front face 22 of the printer 1 includes the front face 22 of the printing unit 3 and the front face 22 of the scanner unit 5. Also, the panel 8 and the front face 22 of the printing unit 3 are located on the same flat plane.

In the printer 1, a face, of the scanner unit 5, that faces vertically upward is an upper face 23. The tank unit 4 is provided in the front face 22 of the printing unit 3. The housing 7 is provided with a window portion 25. The window portion 25 is provided in a front face 26, in the housing 7. Here, the front face 26 of the tank unit 4 faces in the same direction as the front face 22 of the printing unit 3 (Y axis direction, in the present embodiment). The tank unit 4 protrudes in the Y axis direction from the front face 22. Accordingly, the housing 7 of the tank unit 4 protrudes in the Y axis direction from the front face 22. Therefore, the front face 26 of the tank unit 4 is located on the Y axis direction side relative to the front face 22 of the printing unit 3.

Also, an upper face 27 of the tank unit 4 is located on a −Z axis direction side relative to the upper face 23 of the printing unit 3. When the printer 1 is viewed in plan view in the −Z axis direction, the scanner unit 5 is overlapped with a portion of the tank unit 4. The scanner unit 5 is located on the Z axis direction side relative to the upper face 27 of the tank unit 4. A portion of the upper face 27 of the tank unit 4 is covered by the scanner unit 5.

In the tank unit 4, the window portion 25 is optically transparent. The four tanks 10 described above are provided at positions so as to be overlapped with the window portion 25. Each tank 10 is provided with an ink container 29. In each tank 10, ink is contained in the ink container 29. The window portion 25 is provided at a position so as to overlap the ink containers 29 of the tanks 10. Accordingly, an operator that uses the printer 1 can view the ink container 29 of each of the four tanks 10 in the housing 7 using the window portion 25. In the present embodiment, the window portion 25 is provided as an opening formed in the housing 7. The operator can view the four tanks 10 through the window portion 25, which is an opening. Note that the window portion 25 is not limited to an opening, and may be constituted by a member that is optically transparent.

In the present embodiment, at least a portion of a wall of the ink container 29, of each of the tanks 10, that opposes the window portion 25 is optically transparent. The ink inside the ink container 29 can be viewed through the portion, of each of the ink containers 29, that is optically transparent. Accordingly, the operator can recognize the ink amount in the ink container 29 in each of the tanks 10 by viewing the four tanks 10 through the window portion 25. That is, at least a portion of the part, of the tank 10, that opposes the window portion 25 can be utilized as a viewing portion through which the ink amount can be recognized. Therefore, the operator can view the viewing portion of each of the four tanks 10 in the housing 7 using the window portion 25. Note that the entirety of the wall of the ink container 29 may be optically transparent. Also, the entirety of the part, of the tank 10, that opposes the window portion 25 can be utilized as the viewing portion through which the ink amount can be recognized.

In the printer 1, the scanner unit 5 is overlaid on the printing unit 3. In a state in which the printing unit 3 is used, the scanner unit 5 is located vertically above the printing unit 3. The scanner unit 5 is a flatbed type of scanner unit, and includes a document cover 31 that pivots so as to open and close, and a document mounting surface (not shown) that is exposed when the document cover 31 is opened. The scanner unit 5 includes an imaging element (not shown) such as an image sensor. The scanner unit 5 can read an image that is rendered on a document such as a piece of paper that is placed on the document mounting surface as image data using the imaging element. Accordingly, the scanner unit 5 functions as a reading device of an image or the like.

Figure 2:
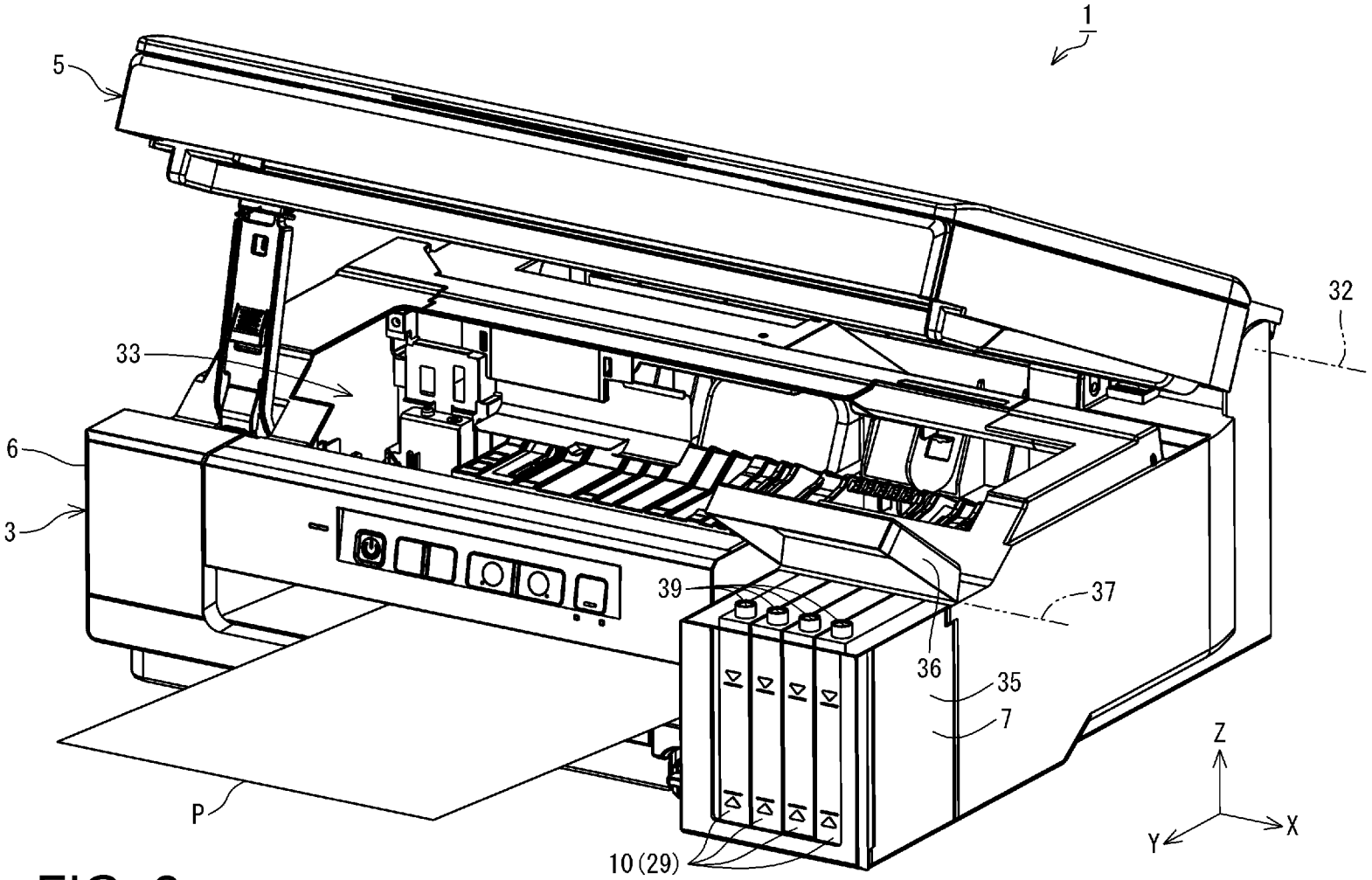
FIG. 2 is a perspective view illustrating the main configuration of the printer in the present embodiment.

The scanner unit 5 is configured to be capable of pivoting relative to the printing unit 3, as shown in FIG. 2. The scanner unit 5 is configured to be capable of pivoting about a pivoting shaft 32 that extends along the X axis. An opening 33 is formed in the housing 6 of the printing unit 3. The scanner unit 5 also functions as a cover that covers the opening 33 of the housing 6 of the printing unit 3. The operator can pivot the scanner unit 5 relative to the printing unit 3 by lifting the scanner unit 5 in the Z axis direction. Accordingly, the scanner unit 5 that functions as a cover for the printing unit 3 can be opened relative to the printing unit 3. When the scanner unit 5 is opened relative to the printing unit 3, the opening 33 of the housing 6 is opened. In FIG. 2, a state in which the scanner unit 5 is opened relative to the printing unit 3, that is, a state in which the opening 33 of the housing 6 is exposed is illustrated.

Note that the state in which the scanner unit 5 is opened relative to the printing unit 3, that is, the state in which the opening 33 of the housing 6 is exposed, is referred to as an open state. Also, the state in which the scanner unit 5 is closed relative to the printing unit 3, that is, the state in which the opening 33 of the housing 6 is covered by the scanner unit 5, is referred to as a closed state. Therefore, in the printer 1, the scanner unit 5 is a body cover that can be switched between a closed state in which the opening 33 formed in the housing 6 is covered and an open state in which the opening 33 is exposed. Also, the state of the scanner unit 5, which is an example of a body cover, changes from a closed state to an open state as the posture of the scanner unit 5 changes relative to the housing 6 as a result of pivoting. That is, in the printer 1, the state of the scanner unit 5, which is an example of a body cover, can be changed from a closed state to an open state as a result of pivoting.

Note that the body cover that can switch between a closed state and an open state is not limited to the scanner unit 5. A simple body cover that only has the function of a cover can be adopted as the body cover, if the body cover is configured to be switchable between a closed state in which the opening 33 formed in the housing 6 is covered and an open state in which the opening 33 is exposed. That is, even in a printer 1 in which the scanner unit 5 is omitted, a configuration can be adopted in which a body cover that can be switched between a closed state and an open state relative to the housing 6 in which the opening 33 is formed is included.

Also, as shown in FIG. 2, the housing 7 includes a body portion 35 and a tank cover 36. The tank cover 36 is configured to be capable of pivoting relative to the body portion 35, and is configured to be capable of opening and closing the body portion 35. The tank cover 36 is configured to be capable of pivoting about a pivoting shaft 37 that extends along the X axis. The tanks 10 are housed in the body portion 35. The tank cover 36 functions as a cover that covers the body portion 35. As a result of a force in the Z axis direction acting on the tank cover 36, the tank cover 36 pivots relative to the body portion 35. Accordingly, the tank cover 36 that functions as a cover for the body portion 35 is opened relative to the body portion 35. The state of the tank cover 36 changes from a closed state to an open state as the posture of the tank cover 36 changes relative to the body portion 35 as a result of pivoting. That is, in the printer 1, the state of the tank cover 36 can be changed from a closed state to an open state as a result of pivoting.

Each tank 10 includes an ink inlet port 39. In the tank 10, ink is injected and filled into the tank 10 from the outside of the tank 10 through the ink inlet port 39. When the tank cover 36 is opened relative to the body portion 35, the ink inlet ports 39 of the tanks 10 are exposed. Note that, in FIG. 2, the state in which the tank cover 36 is opened relative to the body portion 35, that is, the state in which the ink inlet ports 39 of the tanks 10 are exposed is illustrated.

The state in which the tank cover 36 is opened relative to the body portion 35, that is, the state in which the ink inlet ports 39 of the tanks 10 are exposed, is referred to as an open state. Also, the state in which the tank cover 36 is closed relative to the body portion 35, that is, the state in which the ink inlet ports 39 of the tanks 10 are covered by the tank cover 36 is referred to as a closed state. Therefore, in the printer 1, the tank cover 36 is configured to be capable of being switched between a closed state in which the ink inlet ports 39 of the tanks 10 are covered and an open state in which the ink inlet ports 39 are exposed.

A configuration in which each ink inlet port 39 is sealed by a cap member (not shown) can be adopted as the printer 1. In this configuration, when ink is injected into a tank 10, the tank cover 36 is brought into an open state, an ink inlet port 39 is opened by removing a cap member from the ink inlet port 39, and thereafter ink is injected. Note that, in the printer 1, the ink inlet port 39 is directed upward relative to the horizontal direction in a use posture.

Figure 3:
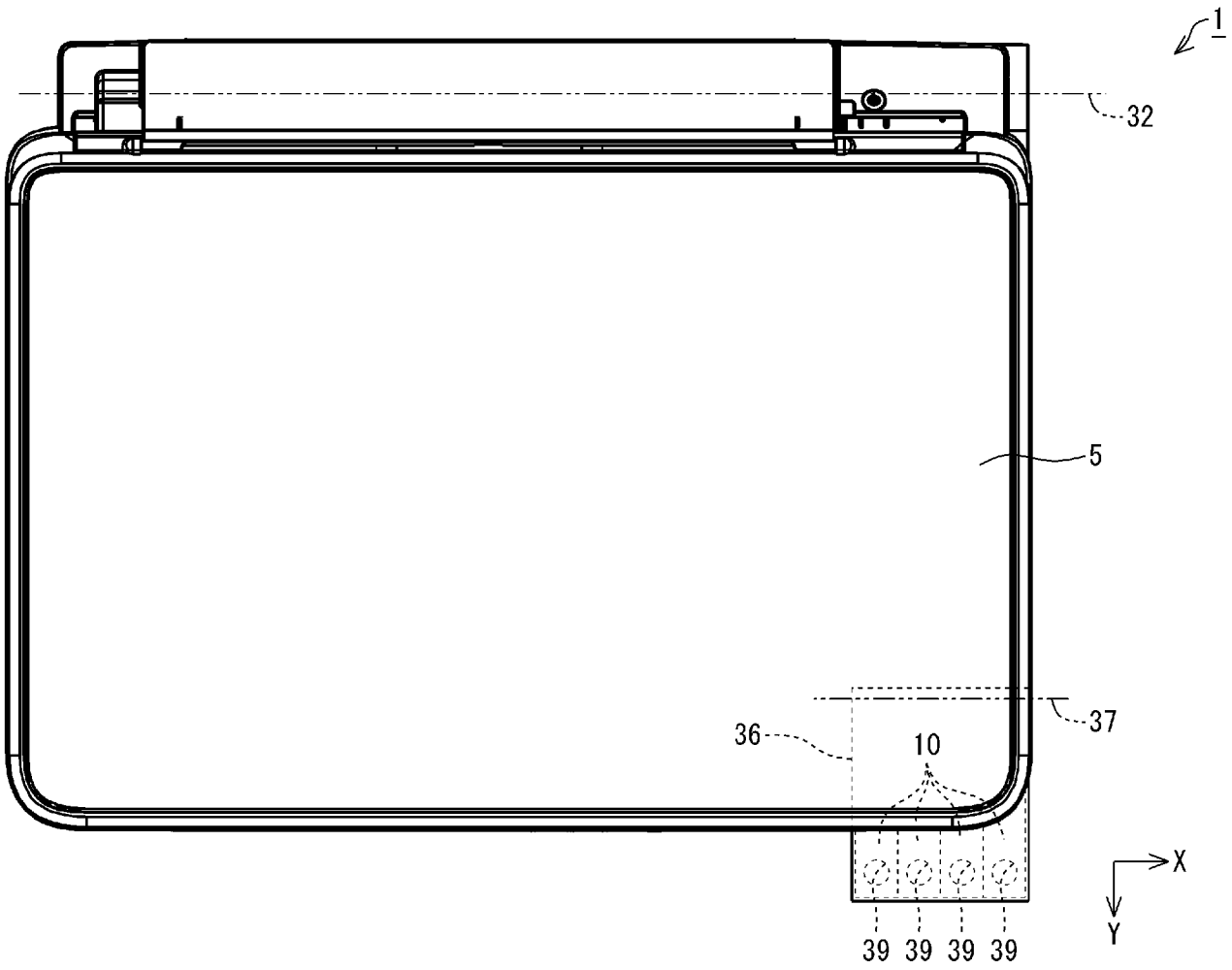
FIG. 3 is a plan view illustrating the main configuration of the printer in the present embodiment.

In the printer 1, when the tank cover 36 and the scanner unit 5 are each in a closed state, the scanner unit 5 is overlapped with a portion of the tank cover 36, as shown in FIG. 1. That is, in a use posture, when the scanner unit 5 in a closed state is viewed in plan view in the −Z axis direction, the scanner unit 5 covers a portion of the tank cover 36, as shown in FIG. 3. Accordingly, when the scanner unit 5 is in a closed state, the tank cover 36 is also in a closed state. When the scanner unit 5 is in an open state, the tank cover 36 can be brought into an open state.

Also, in the printer 1, the ink inlet ports 39 are located outside the region of the scanner unit 5, as shown in FIG. 3. In the printer 1, the ink inlet ports 39 are located on the Y axis direction side relative to the scanner unit 5. Therefore, in the printer 1, when the scanner unit 5 in a closed state is viewed in plan view in the −Z axis direction, the scanner unit 5 is not overlapped with the ink inlet ports 39. Therefore, blockage of the ink inlet port 39 by the scanner unit 5 can be easily avoided. As a result, a printer 1 in which ink can be easily injected into the ink inlet port 39 of a tank 10 can be provided.

Figure 4:
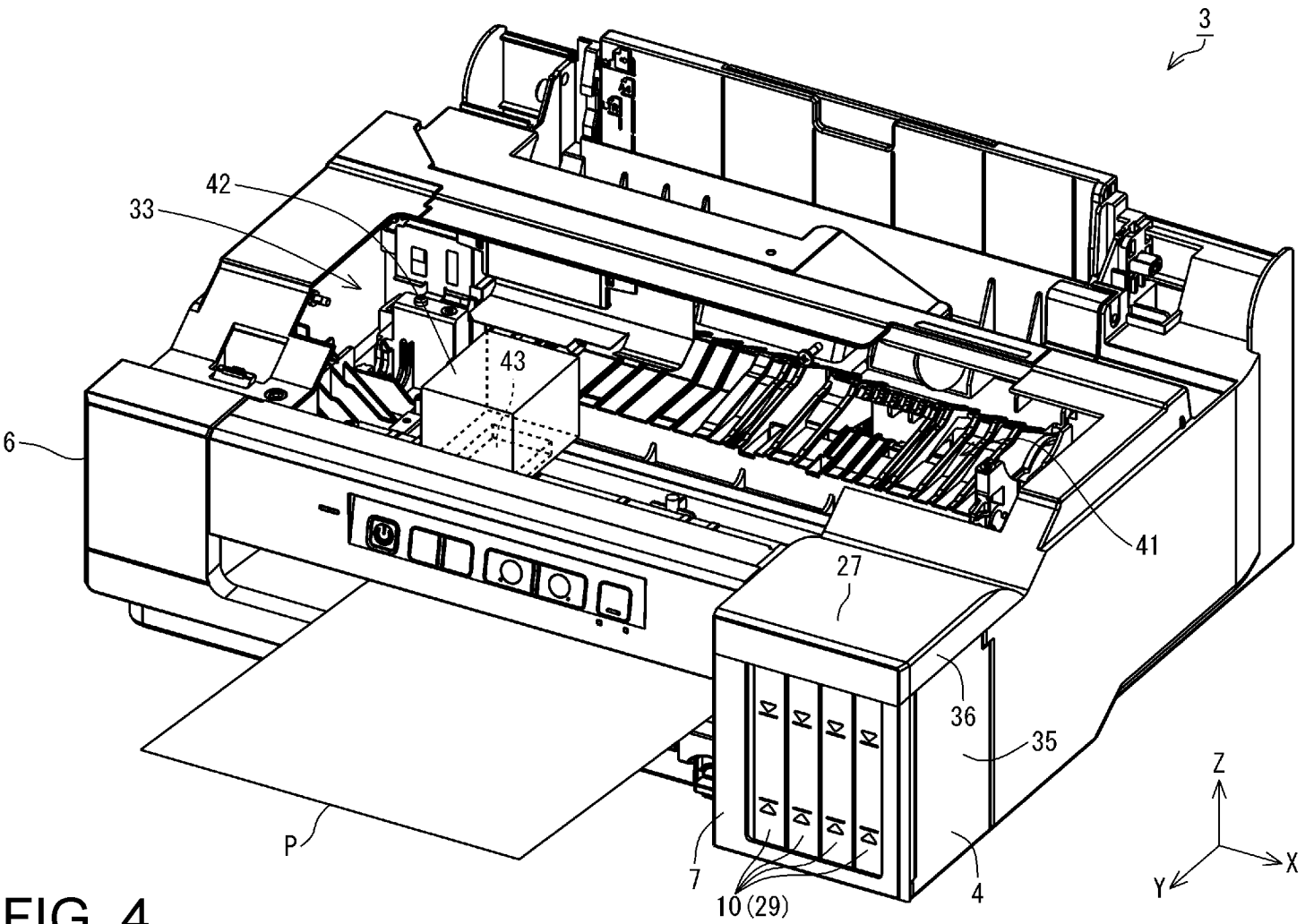
FIG. 4 is a perspective view illustrating a main configuration of a printing unit in the present embodiment.

The printing unit 3 includes a mechanism unit 41, as shown in FIG. 4. The mechanism unit 41 includes a carriage 42. A printing head 43 that can eject ink is mounted on the carriage 42. In the printing unit 3, the carriage 42 is housed in the housing 6. That is, the housing 6 houses the printing head 43. The printing head 43 performs printing on a printing medium P that is conveyed in the Y axis direction by a conveyance device (not shown) using ink. Note that the unshown conveyance device intermittently conveys a printing medium P in the Y axis direction. The carriage 42 is configured to be capable of being moved back and forth along the X axis by a moving device (not shown). The tank unit 4 supplies ink to the printing head 43 via unshown ink supply tubes.

Here, a direction parallel with the X axis is not limited to a direction that is perfectly parallel with the X axis, and also includes a direction that is inclined relative to the X axis due to an error, a tolerance, or the like, excluding a direction perpendicular to the X axis. Similarly, a direction parallel with the Y axis is not limited to a direction that is perfectly parallel with the Y axis, and also includes a direction that is inclined relative to the Y axis due to an error, a tolerance, or the like, excluding a direction perpendicular to the Y axis. A direction parallel with the Z axis is not limited to a direction that is perfectly parallel with the Z axis, and also includes a direction that is inclined relative to the Z axis due to an error, a tolerance, or the like, excluding a direction perpendicular to the Z axis. That is to say, a direction parallel to an axis or a plane is not limited to a direction that is perfectly parallel with this axis or plane, and also includes a direction that is inclined relative to this axis or plane due to an error, a tolerance, or the like, excluding a direction perpendicular to this axis or plane.

The tank unit 4 includes the tanks 10. In the present embodiment, the tank unit 4 includes a plurality of (four, present embodiment) tanks 10. The plurality of tanks 10 are located outside the housing 6 of the printing unit 3. The plurality of tanks 10 are housed in the housing 7. Accordingly, the tanks 10 can be protected by the housing 7. The housing 7 is located outside the housing 6. Note that, in the present embodiment, the tank unit 4 includes the plurality of (four) tanks 10. However, the number of tanks 10 is not limited to four, and may be three or less, or more than four.

Furthermore, in the present embodiment, the plurality of tanks 10 are configured to be separate from each other. However, the configuration of the tanks 10, which are one example of a liquid container, is not limited in this way. The liquid container can be configured as a single liquid container in which the plurality of tanks 10 are integrated. In this case, one liquid container is provided with a plurality of liquid container portions. The plurality of liquid container portions are configured to be individually separated from each other and be able to contain different types of liquids. In this case, for example, ink of different colors can be separately contained in the respective liquid container portions. The method for integrating the plurality of tanks 10 into a single liquid container includes a method in which the plurality of tanks 10 are integrally joined or coupled, a method in which the plurality of tanks 10 are integrated through an integral molding, and the like.

In the printer 1, the tank cover 36 changes from a closed state to an open state, triggered by the scanner unit 5 changing from a closed state to an open state, as shown in FIG. 2. That is, in the printer 1, when the scanner unit 5 is opened, the tank cover 36 is opened. Various examples will be described with respect to the configuration in which the tank cover 36 changes from a closed state to an open state, triggered by the scanner unit 5 changing from a closed state to an open state.

Note that, in the following examples, members that have functions similar to, and members that are the same as the members (hereinafter, referred to as constituent members) that constitute the printer 1 described above will be denoted by the same reference signs as the constituent members of the printer 1, and will not be described in detail.

Example 1

Figure 5:
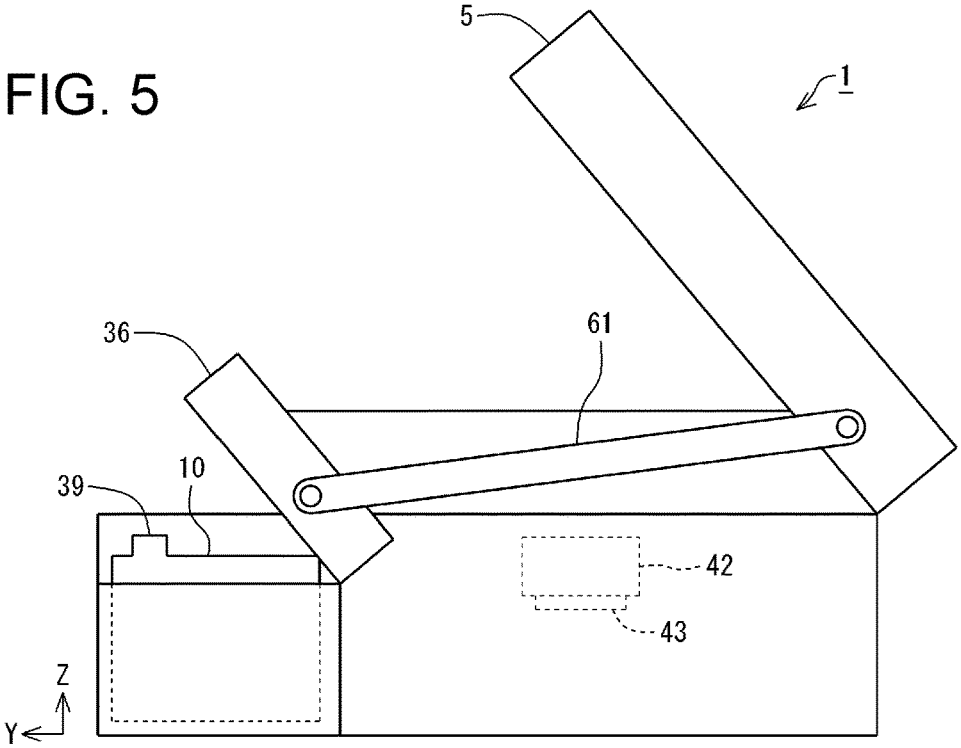
FIG. 5 is a diagram schematically illustrating a configuration of Example 1.

The configuration of Example 1 includes a link mechanism 61, as shown in FIG. 5. The tank cover 36 is connected to the scanner unit 5 via the link mechanism 61. The link mechanism 61 transfers movement of the scanner unit 5 to the tank cover 36. Therefore, when the scanner unit 5 is changed from a closed state to an open state, the movement of the scanner unit 5 is transferred to the tank cover 36 via the link mechanism 61, and as a result, the tank cover 36 can be changed from the closed state to the open state. That is, in the configuration of Example 1, when the scanner unit 5 is opened, the tank cover 36 is opened. Therefore, in the configuration of Example 1, the tank cover 36 can be changed from a closed state to an open state, triggered by the scanner unit 5 changing from a closed state to an open state, by the link mechanism 61. As a result, a printer 1 in which ink can be easily injected and filled into the tank 10 through the ink inlet port 39 can be provided.

Also, in the configuration of Example 1, when the scanner unit 5 is changed from an open state to a closed state, the movement of the scanner unit 5 is transferred to the tank cover 36 via the link mechanism 61, and as a result, the tank cover 36 can be changed from an open state to a closed state. That is, in the configuration of Example 1, when the scanner unit 5 is closed, the tank cover 36 is closed. Therefore, in the configuration of Example 1, the tank cover 36 can be changed from an open state to a closed state, triggered by the scanner unit 5 changing from an open state to a closed state, by the link mechanism 61. That is, in the configuration of Example 1, the tank cover 36 can be opened and closed in conjunction with the opening and closing of the scanner unit 5.

Here, in general, a printer is provided with a sensor that detects the opening and closing of the scanner unit 5 and the opening and closing of the tank cover 36. In order to avoid a case where the printer is operating while the scanner unit 5 or the tank cover 36 is in an open state, the opening and closing of the scanner unit 5 and the opening and closing of the tank cover 36 are detected by sensors. In known printers, because the opening and closing of the scanner unit 5 and the opening and closing of the tank cover 36 are independent from each other, a sensor for detecting the opening and closing of the scanner unit 5 and a sensor for detecting the opening and closing of the tank cover 36 need to be separately provided.

In contrast, in the printer 1 of the present example, the tank cover 36 can be opened and closed in conjunction with the opening and closing of the scanner unit 5, and as a result, whether the scanner unit 5 and the tank cover 36 are in an open state or in a closed state can be grasped by detecting one of the opening and closing of the scanner unit 5 and the opening and closing of the tank cover 36. Therefore, in the printer 1 of the present example, one sensor can be used as the sensor for detecting the opening and closing of the scanner unit 5 and as the sensor for detecting the opening and closing of the tank cover 36. As a result, the number of sensors can be reduced, and the cost of the printer 1 can be reduced.

Example 2

Figure 6:
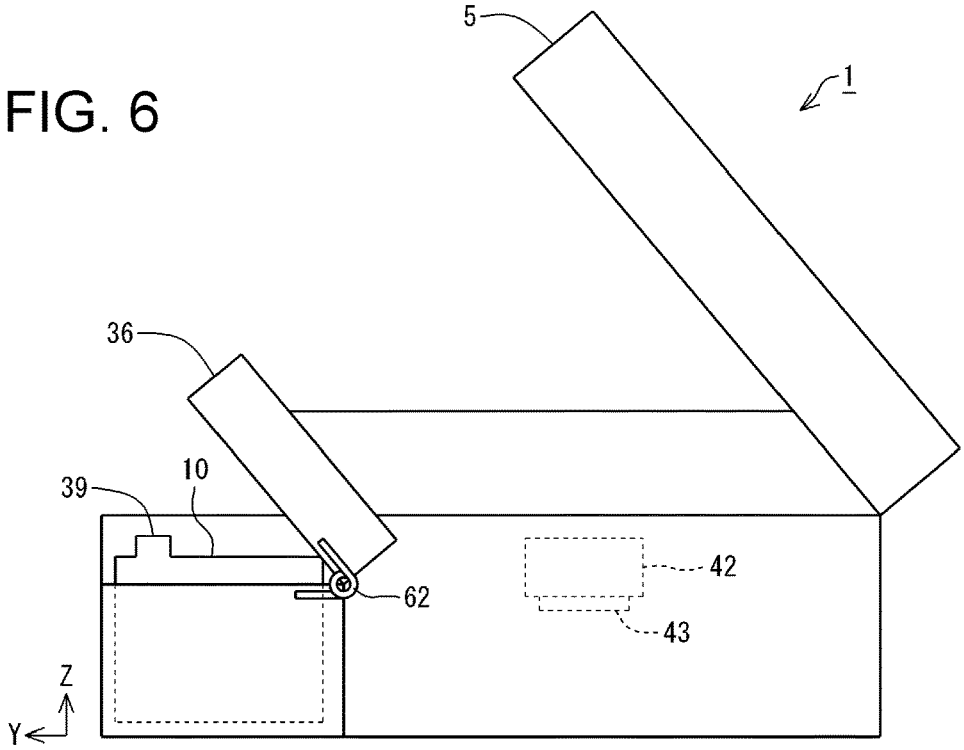
FIG. 6 is a diagram schematically illustrating a configuration of Example 2.

The configuration of Example 2 includes a biasing member 62, as shown in FIG. 6. The biasing member 62 is constituted by a plate spring, a torsion coil spring, or the like, and biases the tank cover 36 toward an open state thereof. The scanner unit 5, when in a closed state, presses the tank cover 36 toward a closed state thereof. Therefore, the scanner unit 5, when in a closed state, keeps the tank cover 36 in a closed state against the biasing force of the biasing member 62. When the scanner unit 5 is changed from a closed state to an open state, the tank cover 36 changes from a closed state to an open state due to the biasing force of the biasing member 62. That is, in the configuration of Example 2, when the scanner unit 5 is opened, the tank cover 36 is opened. Therefore, in the configuration of Example 2, the tank cover 36 can be changed from a closed state to an open state, triggered by the scanner unit 5 changing from a closed state to an open state, by the biasing member 62.

Example 3

Figure 7:
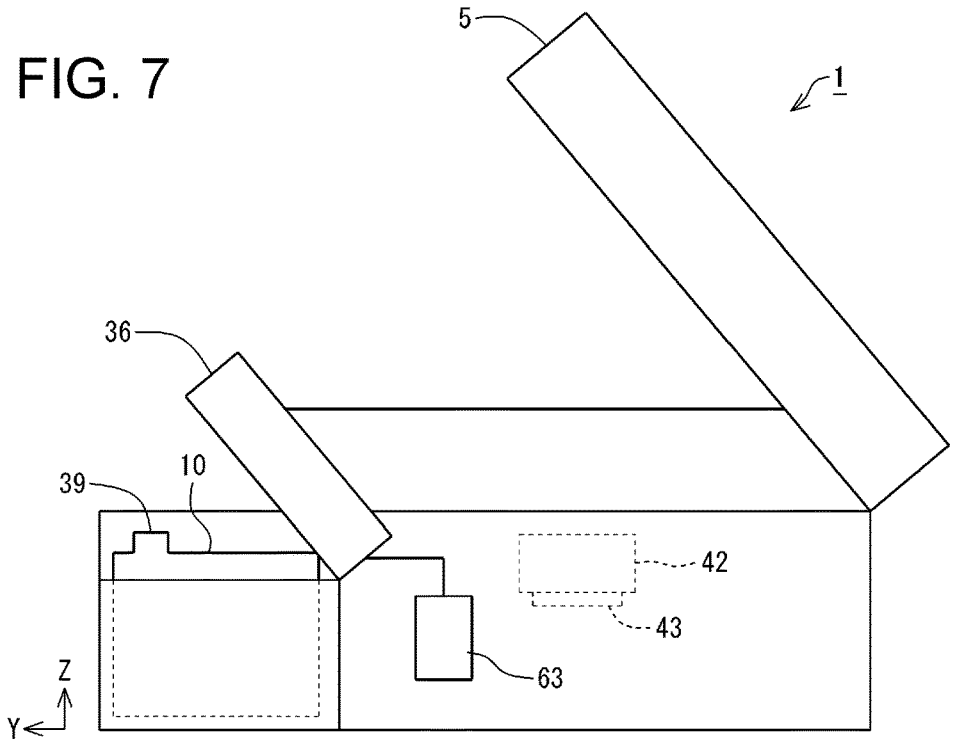
FIG. 7 is a diagram schematically illustrating a configuration of Example 3.

The configuration of Example 3 includes an actuator 63, as shown in FIG. 7. The actuator 63 is constituted by a stepping motor or the like, for example, and generates power for opening and closing the tank cover 36. The power from the actuator 63 is transmitted to the tank cover 36 via a transmission mechanism (not shown). In Example 3, the driving of the actuator 63 is controlled based on the result of detecting the opening and closing of the scanner unit 5 by an unshown sensor. An optical sensor, a microswitch, or the like can be adopted as the sensor. The driving of the actuator 63 is controlled such that the tank cover 36 is changed from a closed state to an open state when the sensor has detected that the scanner unit 5 is being opened. That is, in the configuration of Example 3, when the scanner unit 5 is opened, the tank cover 36 is opened. Therefore, in the configuration of Example 3, the tank cover 36 can be changed, by the actuator 63, from a closed state to an open state, triggered by the scanner unit 5 changing from a closed state to an open state.

Also, in the configuration of Example 3, a method for controlling the driving of the actuator 63 such that the tank cover 36 is changed from an open state to a closed state when the sensor has detected that the scanner unit 5 is being closed can be adopted. Accordingly, when the scanner unit 5 is changed from an open state to a closed state, the tank cover 36 can change from an open state to a closed state. That is, in the configuration of Example 3, when the scanner unit 5 is closed, the tank cover 36 is closed. Therefore, in the configuration of Example 3, the tank cover 36 can be changed, by the actuator 63, from an open state to a closed state, triggered by the scanner unit 5 changing from an open state to a closed state. That is, in the configuration of Example 3, the tank cover 36 can be opened and closed in conjunction with the opening and closing of the scanner unit 5.

Example 4

Figure 8:
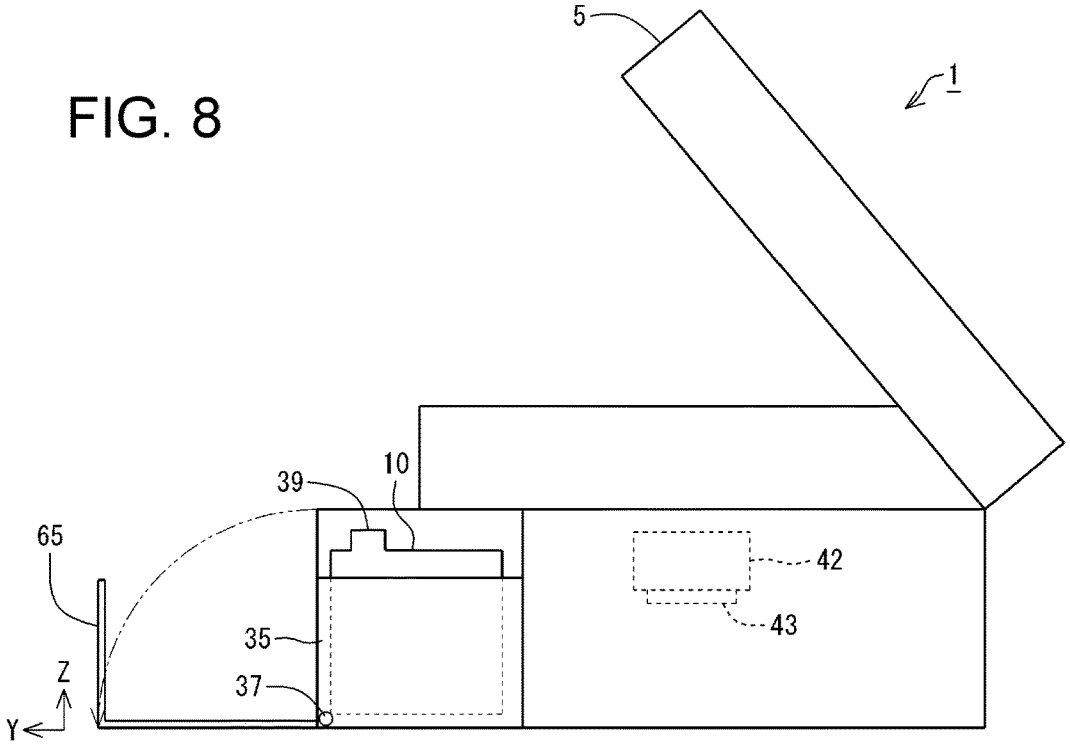
FIG. 8 is a diagram schematically illustrating a configuration of Example 4.

The configuration of Example 4 includes a tank cover 65, as shown in FIG. 8. In the configuration of Example 4, the tank cover 36 in the embodiment described above is replaced by the tank cover 65. As for the tank cover 36, the tank cover 36 is opened relative to the body portion 35 due to a force in the Z axis direction acting thereon. In other words, the tank cover 36 is opened in the Z axis direction. In contrast, as for the tank cover 65, the tank cover 65 is opened relative to the body portion 35 due to a force in the Y axis direction acting thereon. In other words, the tank cover 65 is opened in the Y axis direction.

In the configuration of Example 4 as well, similarly to Examples 1 to 3, the tank cover 65 can be changed, by the link mechanism 61, the biasing member 62, the actuator 63, or the like, from a closed state to an open state, triggered by the scanner unit 5 changing from a closed state to an open state. Accordingly, Example 4 can also achieve effects similar to those of Examples 1 to 3.

Example 5

In a configuration of Example 5, in a use posture of the printer 1, when the tank cover 65 is in a closed state, the tank cover 65 is biased toward an open state due to the gravity acting on the tank cover 65. That is, a biasing force acts on the tank cover 65 in a direction from a closed state to an open state. This is achieved by setting the center of gravity of the tank cover 65 in a closed state at a position on the Y axis direction side relative to a pivoting shaft 37 of the tank cover 65. Also, when the tank cover 65 is in a closed state and the scanner unit 5 is in a closed state, the tank cover 36 is locked by the scanner unit 5. Accordingly, when the tank cover 65 is in a closed state and the scanner unit 5 is in a closed state, the tank cover 36 is kept in a closed state.

At this time, when the scanner unit 5 is changed from a closed state to an open state, the locking of the tank cover 36 by the scanner unit 5 is released, and the tank cover 65 that is biased toward an open state changes to an open state. Accordingly, the tank cover 65 changes from a closed state to an open state. That is, in the configuration of Example 5, when the scanner unit 5 is opened, the tank cover 65 is opened. Therefore, in the configuration of Example 5, the tank cover 65 can change from a closed state to an open state, triggered by the scanner unit 5 changing from a closed state to an open state.

Furthermore, in the configuration of Example 5, when a biasing member 62 is added, because the biasing member 62 that biases the tank cover 65 toward an open state is included, the tank cover 65 can be more easily changed from a closed state to an open state.

Example 6

Figure 9:
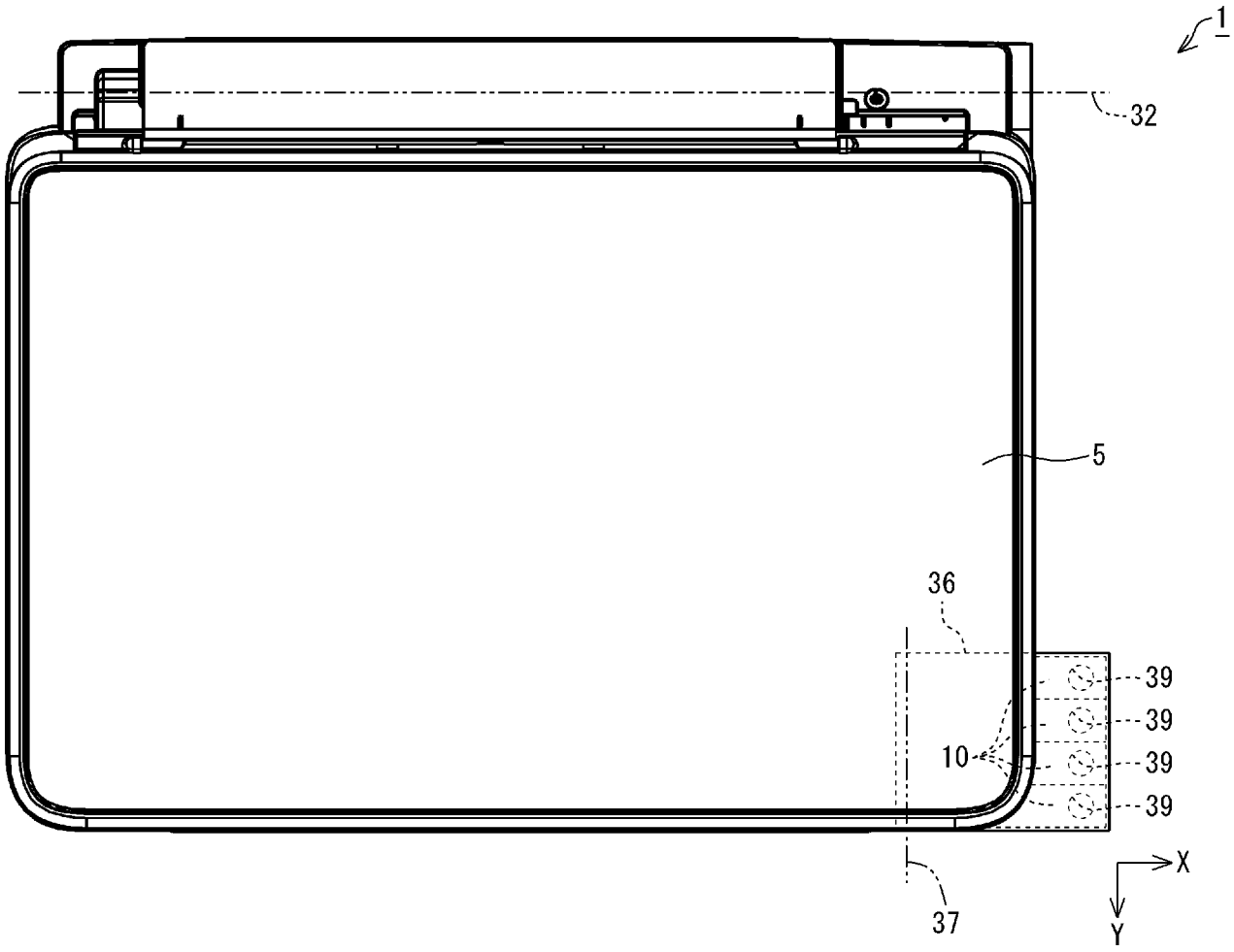
FIG. 9 is a plan view schematically illustrating a configuration of Example 6.

In the embodiment and Examples 1 to 5 described above, the pivoting shafts 37 of the tank cover 36 and the tank cover 65 extend along the X axis. However, the extension direction of the pivoting shaft 37 of each of the tank cover 36 and the tank cover 65 is not limited thereto. A direction along the Y axis can be adopted as the extension direction of the pivoting shaft 37 as shown in FIG. 9, for example. The example shown in FIG. 9 is Example 6. In Example 6, a plurality of tanks 10 are arranged along the Y axis. Accordingly, a plurality of ink inlet ports 39 are arranged along the Y axis. In Example 6 as well, the ink inlet ports 39 are located outside the region of scanner unit 5. In Example 6, the ink inlet ports 39 are located on the X axis direction side relative to the scanner unit 5. In Example 6 as well, a configuration can be adopted in which the tank cover 36 and the tank cover 65 change from a closed state to an open state, triggered by the scanner unit 5 changing from a closed state to an open state, similarly to Examples 1 to 5. Example 6 can also achieve effects similar to those of the embodiment and Examples 1 to 5 described above.

Example 7

Figure 10:
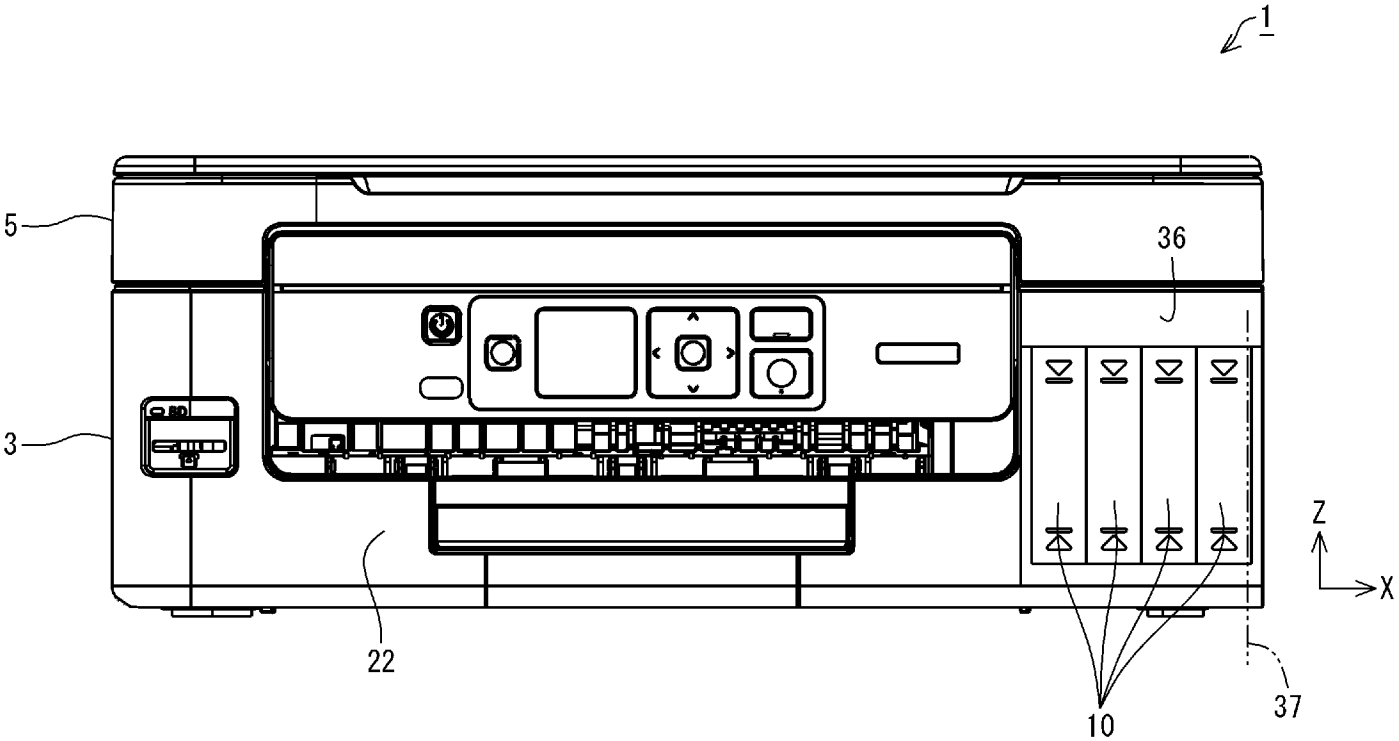
FIG. 10 is a plan view schematically illustrating a configuration of Example 7.
Figure 11:
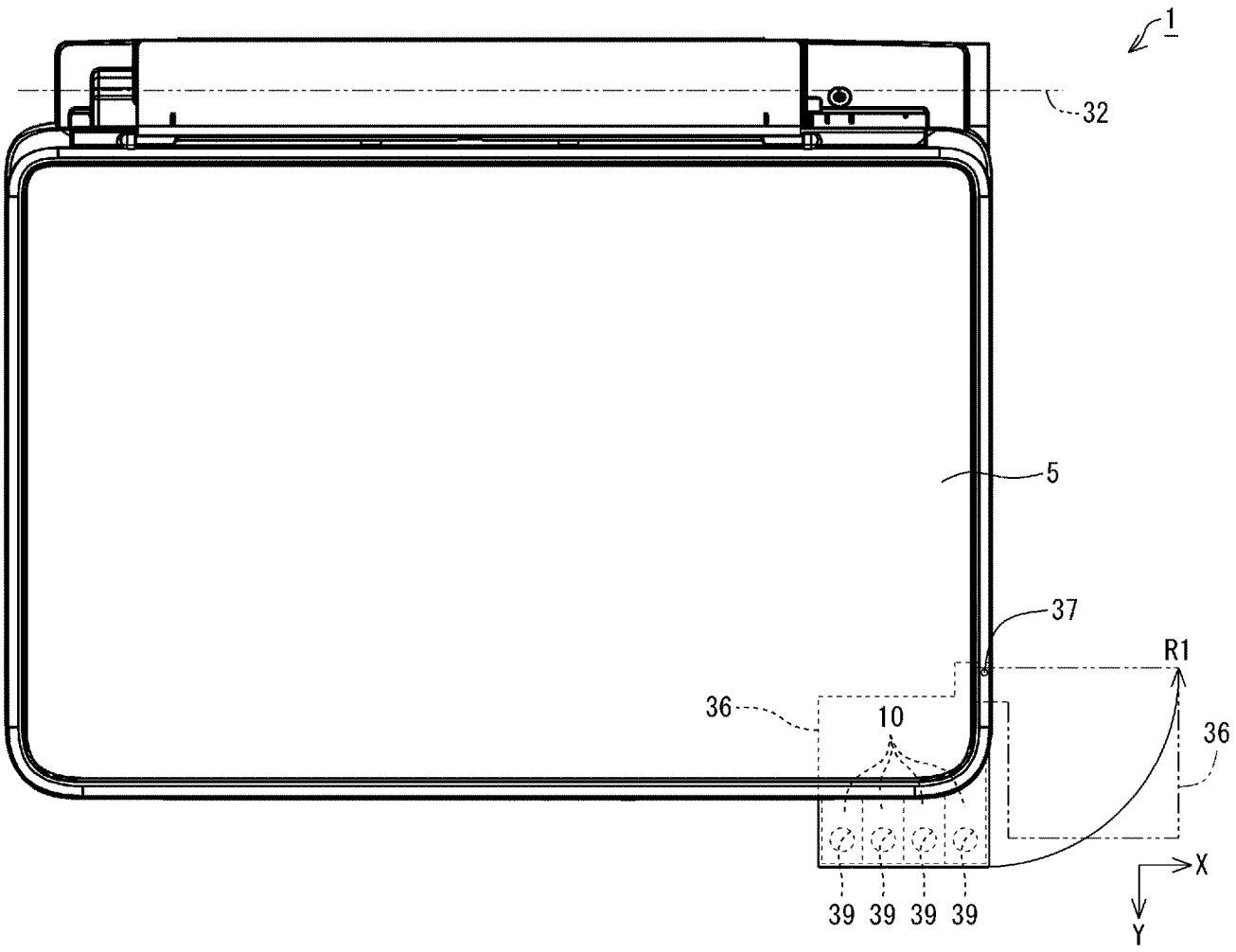
FIG. 11 is a plan view schematically illustrating the configuration of Example 7.

Also, a direction along the Z axis can be adopted as the extension direction of the pivoting shaft 37 as shown in FIG. 10, for example. The example shown in FIG. 10 is Example 7. In Example 7, a plurality of tanks 10 are arranged along the X axis, similarly to Examples 1 to 5. Also, in Example 7 as well, as shown in FIG. 11, ink inlet ports 39 are located on the Y axis direction side relative to the region of scanner unit 5. In Example 7, the tank cover 36 is configured to be pivotable about the pivoting shaft 37 along the Z axis in an R1 direction in the diagram. In Example 7 as well, a configuration can be adopted in which the tank cover 36 changes from a closed state to an open state, triggered by the scanner unit 5 changing from a closed state to an open state, similarly to Examples 1 to 3. Example 7 can also achieve effects similar to those of the embodiment and Examples 1 to 3 described above.

Example 8

Figure 12:
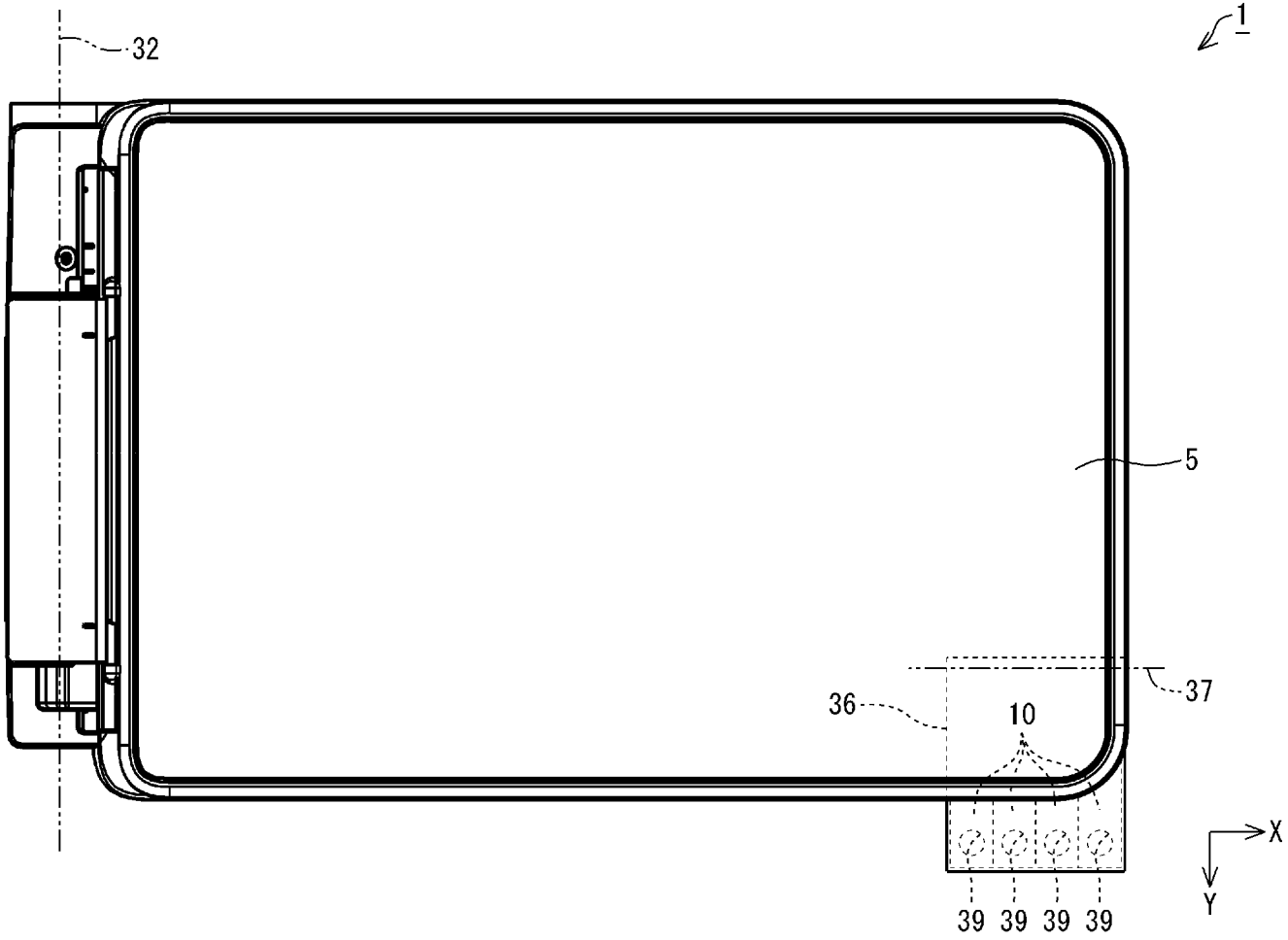
FIG. 12 is a plan view schematically illustrating a configuration of Example 8.

In the embodiment and Examples 1 to 7 described above, the pivoting shaft 32 (FIG. 2) of the scanner unit 5 extends along the X axis. However, the extension direction of the pivoting shaft 32 of the scanner unit 5 is not limited thereto. A direction along the Y axis can be adopted as the extension direction of the pivoting shaft 32 as shown in FIG. 12, for example. The example shown in FIG. 12 is Example 8. Example 8 is configured similarly to each of Examples 1 to 7 except that the pivoting shaft 32 of the scanner unit 5 extends in a direction along the Y axis. In other words, a configuration in which, in Examples 1 to 7, the extension direction of the pivoting shaft 32 of the scanner unit 5 is changed to a direction along the Y axis is Example 8. Example 7 can also achieve effects similar to those of Examples 1 to 7 described above.

Example 9

Figure 13:
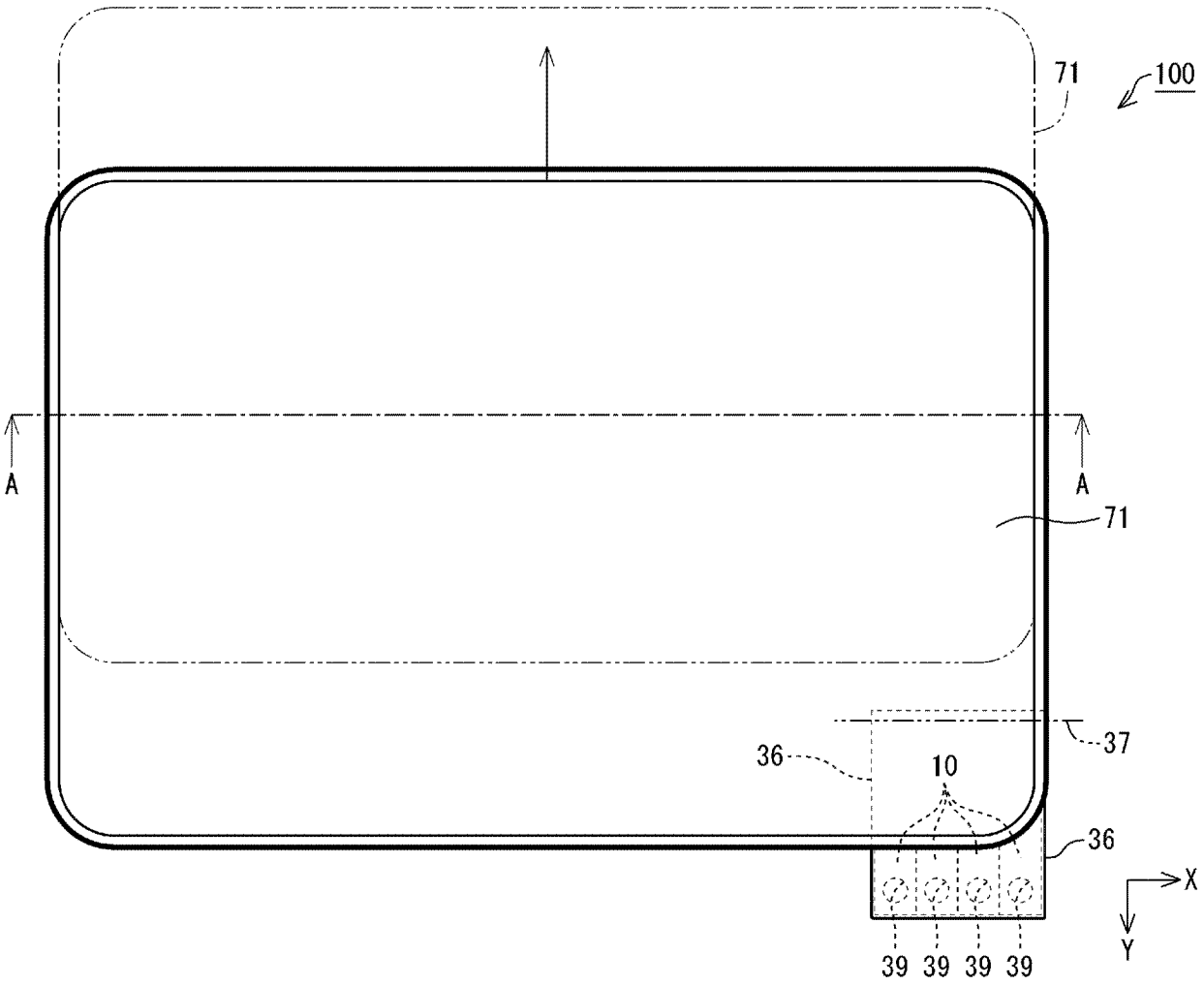
FIG. 13 is a plan view schematically illustrating a configuration of Example 9.
Figure 14:
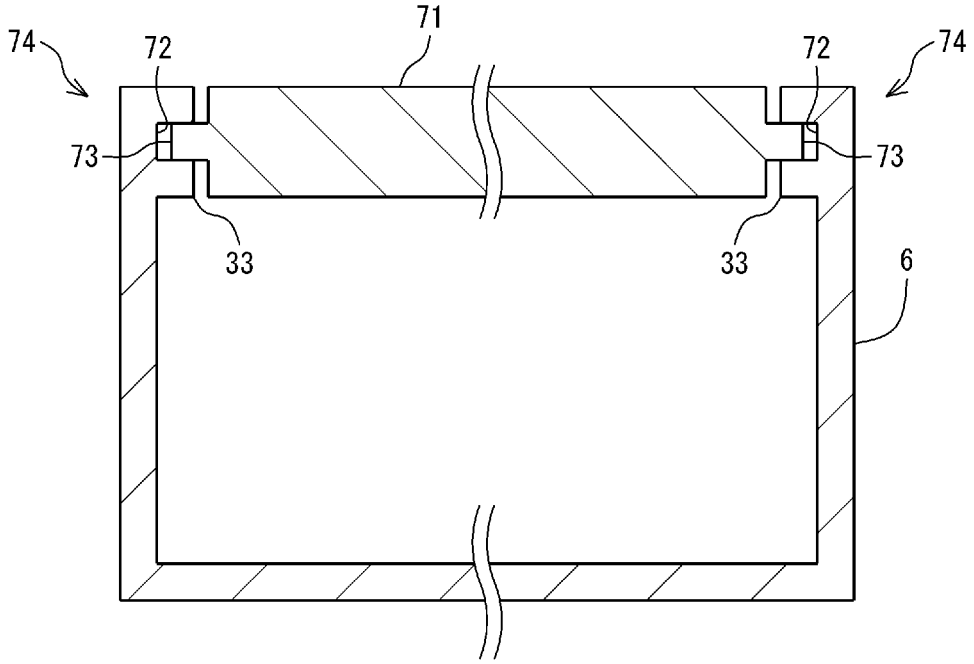
FIG. 14 is a schematic cross-sectional view taken along line A-A in FIG. 13.

In the embodiment and Examples 1 to 7 described above, the printer 1 including the scanner unit 5 as an example of the body cover has been described. However, the configuration of the printer 1 is not limited thereto, and the configuration of a printer 100, shown in FIG. 13, including a body cover 71 in place of the scanner unit 5 can be adopted. The body cover 71 is configured to be slidable along the Y axis. This is realized by a sliding mechanism 74 in which outer rails 72 formed by recessed grooves and inner rails 73 that can engage with the respective outer rails 72 are combined, as shown in FIG. 14, which is a schematic cross-sectional view taken along line A-A in FIG. 13.

The body cover 71 includes the function of a cover that closes off the opening 33 in housing 6. By sliding the body cover 71 in the −Y axis direction, the body cover 71 can be changed from a closed state to an open state. In the printer 100 including such a body cover 71 as well, a configuration can be adopted in which the tank cover 36 and the tank cover 65 change from a closed state to an open state, triggered by the body cover 71 changing from a closed state to an open state.

A configuration in which, in Examples 1 to 7, the scanner unit 5 is replaced by the body cover 71 is Example 9. Excluding the above point, the printer 100 is configured similarly to printer 1. Accordingly, a printer 100 can be configured in which the tank cover 36 and the tank cover 65 change from a closed state to an open state, triggered by the body cover 71 changing from a closed state to an open state. Example 9 can also achieve effects similar to those of Examples 1 to 7 described above. Note that the sliding direction of the body cover 71 is not limited to a direction along the Y axis, and a direction along the X axis can also be adopted. This configuration can also achieve effects similar to those of Examples 1 to 7.

Example 10

Figure 15:
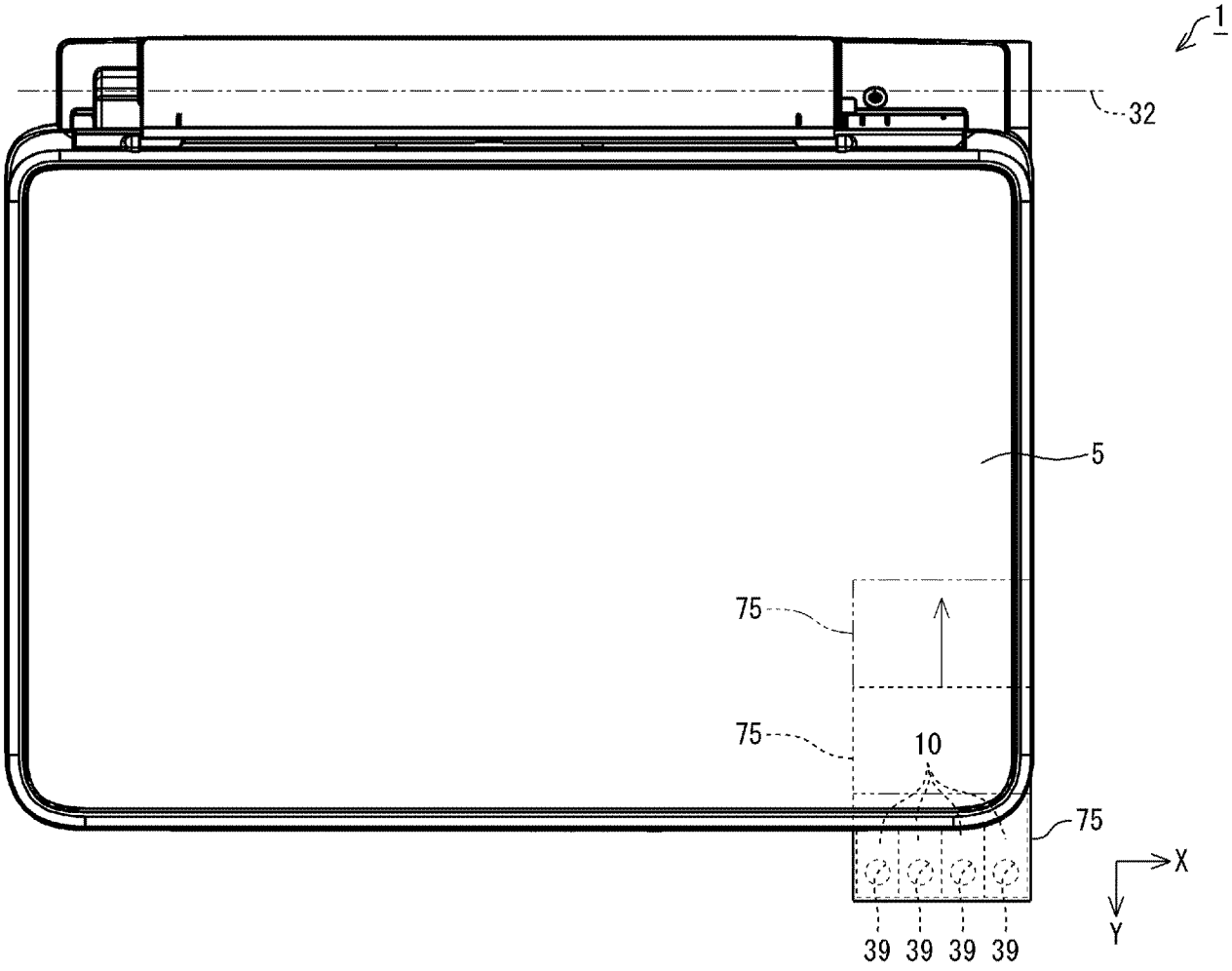
FIG. 15 is a plan view schematically illustrating a configuration of Example 10.

In printer 1, the tank cover 36 is configured to be pivotable. However, the configuration of the printer 1 is not limited thereto. A configuration including a slidable tank cover 75 can be adopted as the configuration of the printer 1, as shown in FIG. 15. The configuration including the slidable tank cover 75 will be described as Example 10. The tank cover 75 is configured to be slidable along the Y axis. This can be realized by a sliding mechanism 74 in which outer rails 72 (FIG. 14) formed by recessed grooves and inner rails 73 that can engage with the respective outer rails 72 are combined, similarly to the body cover 71. In Example 10, by sliding the tank cover 75 in the −Y axis direction, the tank cover 75 is changed from a closed state to an open state.

In Example 10 as well, a configuration can be adopted in which the tank cover 75 changes from a closed state to an open state, triggered by the scanner unit 5 changing from a closed state to an open state. Such a configuration can be realized by the link mechanism 61 in Example 1, the actuator 63 in Example 3, or the like, for example. Accordingly, in Example 10 as well, the tank cover 75 can change from a closed state to an open state, triggered by the scanner unit 5 changing from a closed state to an open state. Accordingly, Example 10 can also achieve effects similar to those of Examples 1 and 3. Note that the sliding direction of the tank cover 75 is not limited to the direction along the Y axis, and a direction along the X axis can be adopted. In this case, a configuration in which a plurality of tanks 10 are arranged along the Y axis can be adopted similarly to Example 6(FIG. 9). Also, the extension direction of the pivoting shaft 32 of the scanner unit 5 is not limited to a direction along the X axis, and a direction along the Y axis can be adopted similarly to Example 8 (FIG. 12).

Example 11

Figure 16:
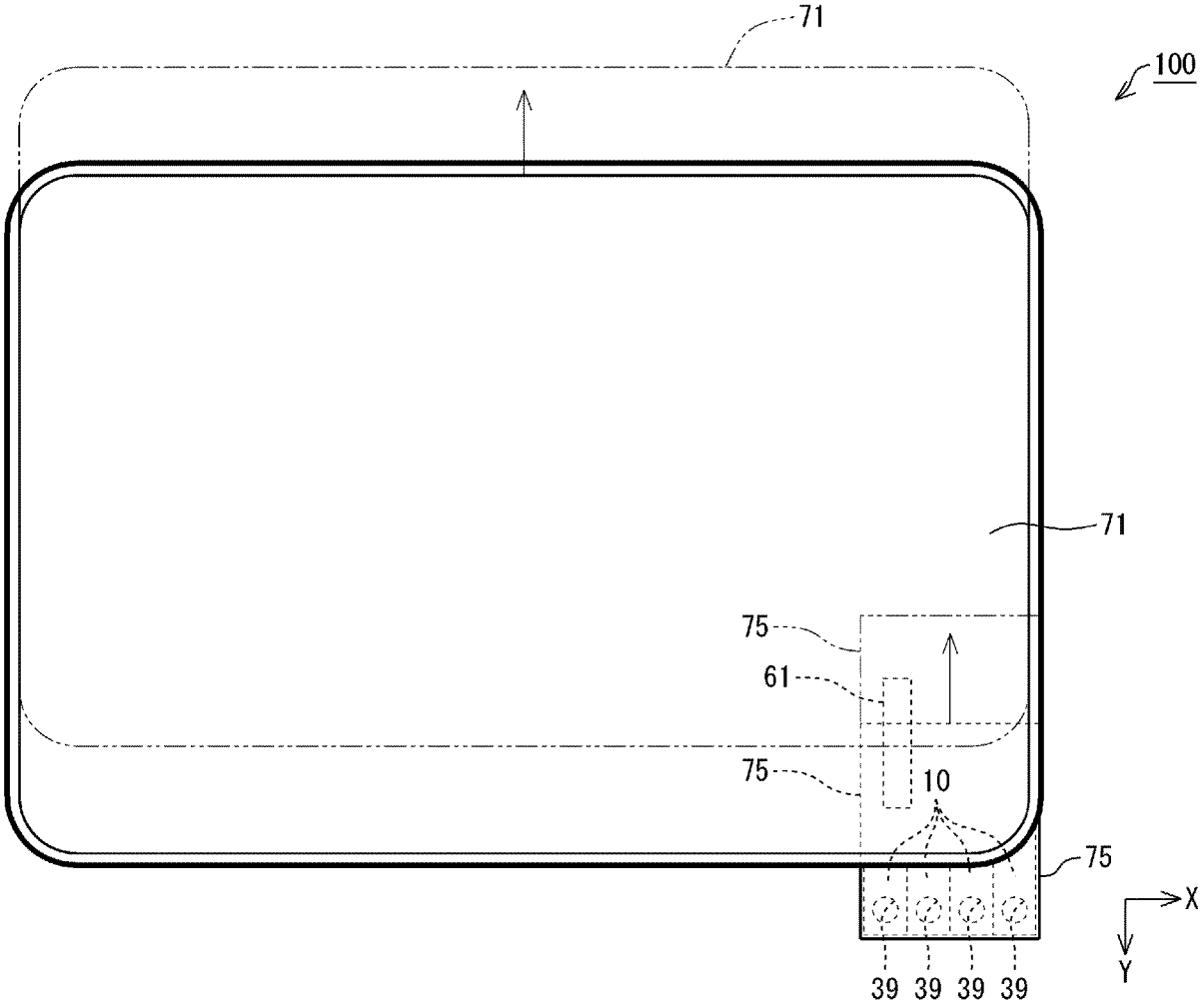
FIG. 16 is a plan view schematically illustrating a configuration of Example 11.

In the printer 100 including the body cover 71, a configuration including the tank cover 75 can be adopted. In this configuration, the body cover 71 and the tank cover 75 are configured to be slidable along the Y axis, as shown in FIG. 16. In this configuration, a configuration can be adopted in which the tank cover 75 changes from a closed state to an open state, triggered by the body cover 71 changing from a closed state to an open state. Such a configuration can be realized using a link mechanism 61 shown in FIG. 16, for example. A printer 100 including the body cover 71, the tank cover 75, and the link mechanism 61 will be described as Example 11.

The link mechanism 61 is configured similarly to that in Example 1. The tank cover 75 is connected to the body cover 71 via the link mechanism 61. The link mechanism 61 transfers movement of the body cover 71 to the tank cover 75. Therefore, when the body cover 71 is changed from a closed state to an open state, since the movement of the body cover 71 is transferred to the tank cover 75 via the link mechanism 61, the tank cover 75 can be changed from a closed state to an open state. Accordingly, in Example 11 as well, the tank cover 75 can change from a closed state to an open state, triggered by the body cover 71 changing from a closed state to an open state. Accordingly, Example 11 can also achieve effects similar to those of Example 1.

Example 12

Figure 17:
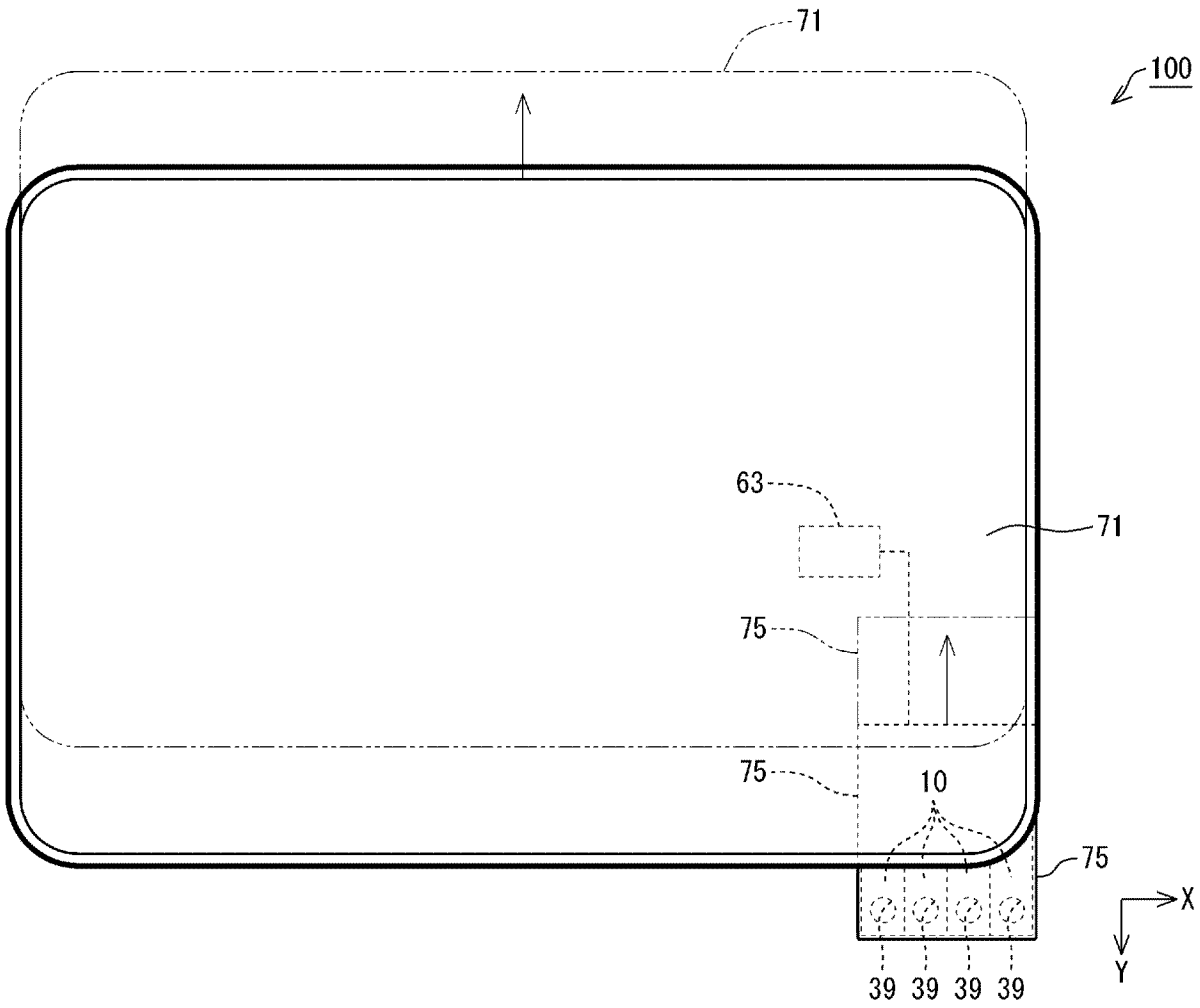
FIG. 17 is a plan view schematically illustrating a configuration of Example 12.

In Example 11 as well, a configuration in which the link mechanism 61 is replaced by an actuator 63 can be adopted. A printer 100 including a body cover 71, a tank cover 75, and an actuator 63 is described as Example 12. The printer 100 in Example 12 includes the body cover 71, the tank cover 75, and the actuator 63, as shown in FIG. 17. The actuator 63 is configured similarly to that in Example 3.

Power from the actuator 63 is transmitted to the tank cover 75 via a transmission mechanism (not shown). In Example 12, the driving of the actuator 63 is controlled based on the result of detecting, by an unshown sensor, the opening and closing of the body cover 71. An optical sensor, a microswitch, and the like can be adopted as the sensor, for example. The driving of the actuator 63 is controlled such that the tank cover 75 is changed from a closed state to an open state based on the detection result that the sensor has detected opening of the body cover 71. Accordingly, in Example 12 as well, the tank cover 75 can change, by the actuator 63, from a closed state to an open state, triggered by the body cover 71 changing from a closed state to an open state. Accordingly, Example 12 can also achieve effects similar to those of Example 3.

Note that, in Examples 11 and 12, the sliding direction of the tank cover 75 is not limited to a direction along the Y axis, and a direction along the X axis can be adopted as well. In this case, a configuration in which a plurality of tanks 10 are arranged along the Y axis, similarly to Example 6 (FIG. 9), can be adopted. Also, the extension direction of the pivoting shaft 32 of the body cover 71 is not limited to a direction along the X axis, and a direction along the Y axis can be adopted, similarly to Example 8 (FIG. 12).

Example 13

Figure 18:
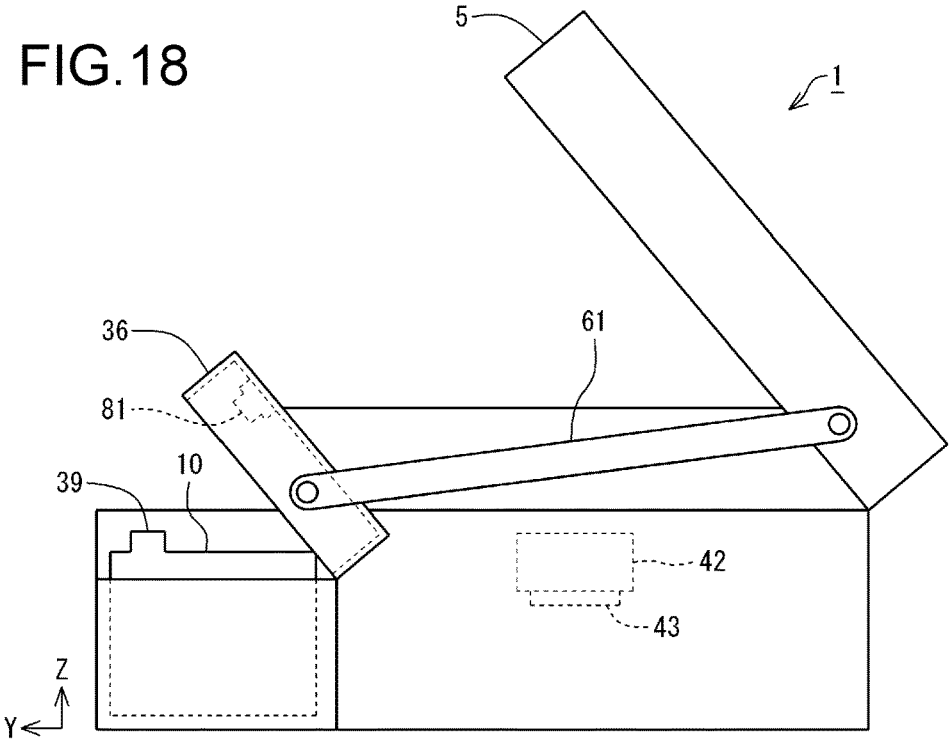
FIG. 18 is a diagram schematically illustrating a configuration of Example 13.

A configuration in which, in Examples 1 to 3, a cap member 81 is provided can be adopted, as shown in FIG. 18. A configuration in which the cap member 81 is provided in Examples 1 to 3 is Example 13. The cap member 81 is configured to be able to attach to and detach from the ink inlet ports 39. When the cap member 81 is attached to the ink inlet ports 39, the cap member 81 closes off the ink inlet ports 39. The state in which the cap member 81 is attached to the ink inlet ports 39 is referred to as a close off state. Also, when the cap member 81 is removed from the ink inlet ports 39, the ink inlet ports 39 are opened. The state in which the cap member 81 is removed from the ink inlet ports 39 is referred to as an open state.

In Example 13, the cap member 81 is provided in the tank cover 36. In the example, the cap member 81 is provided in a state of being connected to the tank cover 36. Specifically, in the present example, the cap member 81 is provided integrally with the tank cover 36. The cap member 81 is provided at a position, in the tank cover 36, that opposes the ink inlet ports 39. The position, in the tank cover 36, that opposes the ink inlet ports 39 is a position that faces the ink inlet ports 39 when the tank cover 36 is in a closed state. Therefore, when the tank cover 36 is closed, the ink inlet ports 39 are closed off by the cap member 81. On the other hand, when the tank cover 36 is opened, the ink inlet ports 39 are opened.

That is, in Example 13, the cap member 81 that closes off the ink inlet ports 39 when the tank cover 36 is in a closed state, and exposes the ink inlet ports 39 when the tank cover 36 is in an open state is integrally provided in the tank cover 36. Therefore, the ink inlet ports 39 can be opened and closed according to the opening and closing of the tank cover 36. Furthermore, in the present example, the cover 36 can change from a closed state to an open state, triggered by the scanner unit 5 changing from a closed state to an open state. Therefore, the ink inlet ports 39 can change from a close off state to an open state, triggered by the scanner unit 5 changing from a closed state to an open state. As a result, a printer 1 in which ink can be easily injected into the tank 10 from the ink inlet port 39 can be provided. Also, in the present example, because the load of the tank cover 36 and the scanner unit 5 is applied to the cap member 81, it is easy to close off the ink inlet ports 39. Note that the configuration of Example 13 can be applied to Examples 6, and 8 to 12, in addition to Examples 1 to 3. Note that the cap member 81 may be connected to the tank cover 36 using a link mechanism such as the link mechanism 61, for example.

Example 14

Figure 19:
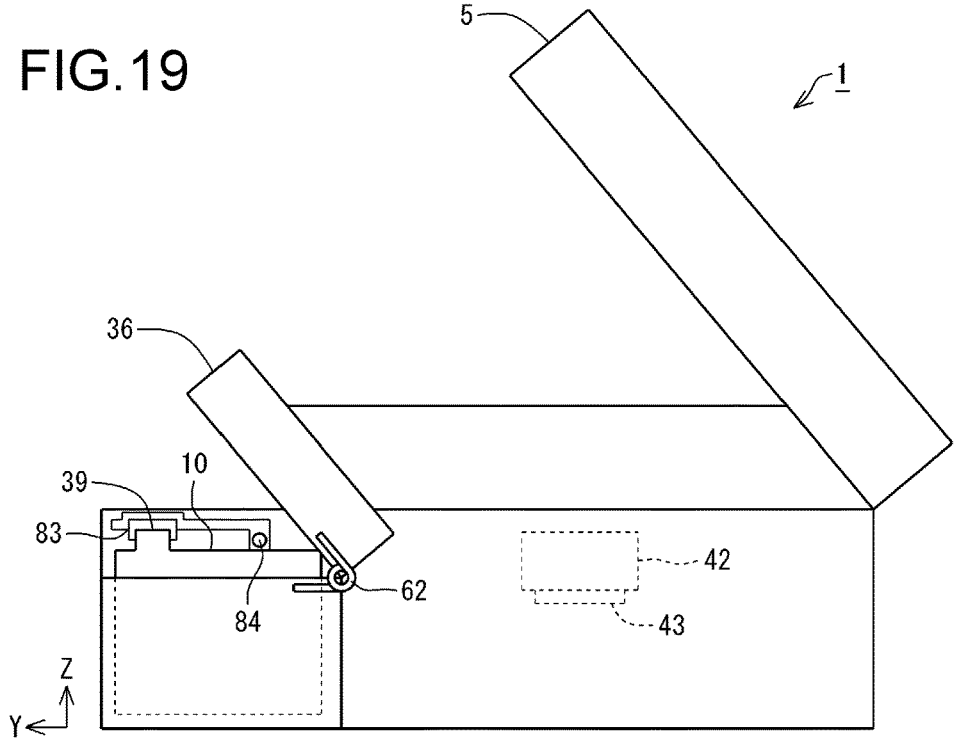
FIG. 19 is a diagram schematically illustrating a configuration of Example 14.

A configuration in which, in Examples 1 to 3, a cap member 83 is provided can be adopted, as shown in FIG. 19. A configuration in which the cap member 83 is provided in Examples 1 to 3 is Example 14. The cap member 83 is configured to be able to attach to and detach from the ink inlet ports 39. When the cap member 83 is attached to the ink inlet ports 39, the cap member 83 closes off the ink inlet ports 39. The state in which the cap member 83 is attached to the ink inlet ports 39 is referred to as a close off state. Also, when the cap member 83 is removed from the ink inlet ports 39, the ink inlet ports 39 are exposed. The state in which the cap member 83 is removed from the ink inlet ports 39 is referred to as an open state.

In Example 14, the cap member 83 is configured to be pivotable about a pivoting shaft 84 that extends along the X axis. The cap member 83 is configured to be switchable between a close off state and an open state by pivoting about the pivoting shaft 84. In Example 14, the attachment and detachment of the cap member 83 relative to the ink inlet port 39 and the opening and closing of the tank cover 36 are independent from each other. That is, even if the tank cover 36 changes from a closed state to an open state, the cap member 83 can be kept in a close off state.

In Example 14, the opening and closing of the tank cover 36 and the attachment and detachment of the cap member 83 relative to the ink inlet ports 39 are independent from each other. Accordingly, even if the tank cover 36 is opened, the cap member 83 remains attached to the ink inlet port 39. Therefore, it is possible to easily avoid a case in which the ink inlet port 39 is unintentionally opened when the scanner unit 5, which is an example of the body cover, is opened to perform maintenance on the printing head 43, for example. As a result, the occurrence of problems such as contaminants intruding into the ink inlet port 39 and ink leaking out from the ink inlet port 39 due to a change in orientation of the printer 1 can be suppressed. Note that the configuration of Example 14 can also be applied to Examples 4 to 12, in addition to Examples 1 to 3.

Example 15

Figure 20:
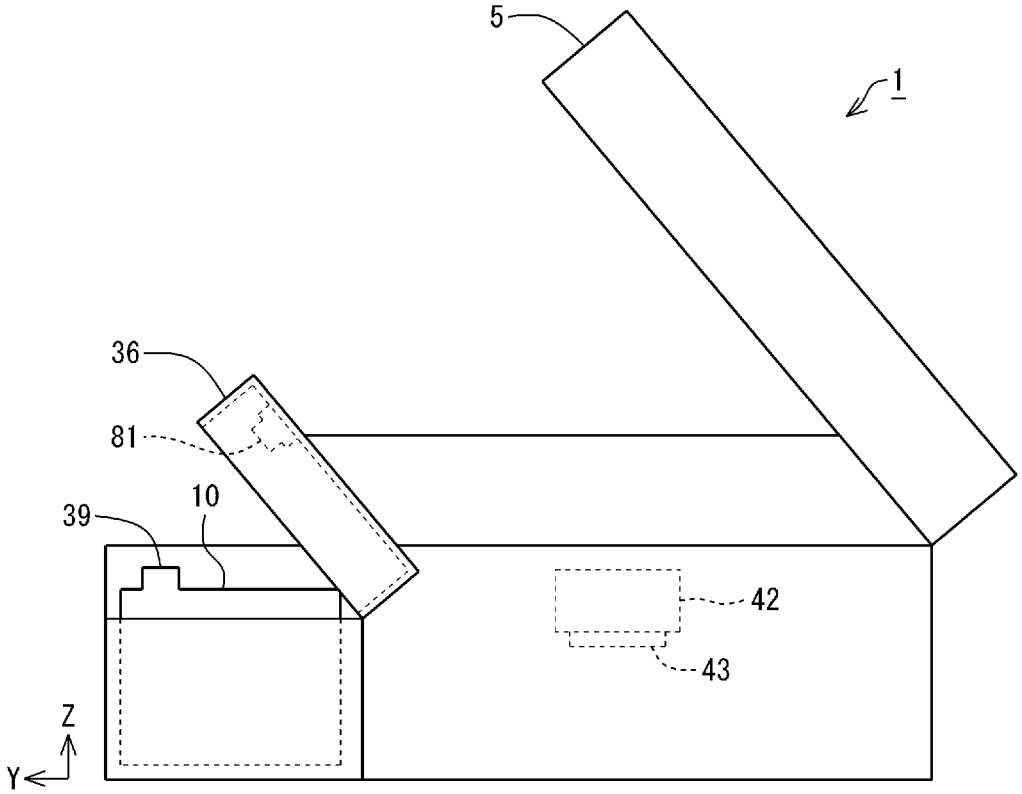
FIG. 20 is a diagram schematically illustrating a configuration of Example 15.

A configuration in which, in Example 13, the link mechanism 61, the biasing member 62, the actuator 63, and the like are omitted can also be adopted, as shown in FIG. 20. A configuration in which, in Example 13, the link mechanism 61, the biasing member 62, the actuator 63, and the like are omitted is Example 15. In Example 15, the opening and closing of the scanner unit 5 and the opening and closing of the tank cover 36 are independent from each other. Therefore, even if the scanner unit 5 is changed from a closed state to an open state, the tank cover 36 can be kept in a closed state.

Note that, in Example 15, the cap member 81 and the tank cover 36 are configured similarly to those in Example 13. Accordingly, in Example 15 as well, the cap member 81 that closes off the ink inlet ports 39 when the tank cover 36 is closed, and exposes the ink inlet ports 39 when the tank cover 36 is opened is integrally provided in the tank cover 36. Therefore, the ink inlet ports 39 can be exposed and closed when the tank cover 36 is opened and closed. As a result, a printer 1 in which ink can be easily injected into the tank 10 from the ink inlet port 39 can be provided. Note that the configuration of Example 15 can be applied to Examples 6 and 8 to 12, in addition to Examples 1 to 3.

In each of the embodiments and examples described above, the liquid ejection device may be a liquid ejection device that consumes a liquid other than ink by ejecting, discharging, or applying the liquid. Note that the states of liquid discharged as very small droplets from the liquid ejection device includes a granular shape, a tear-drop shape, and a shape having a thread-like trailing end. Furthermore, the liquid mentioned here may be any kind of material that can be consumed by the liquid ejection device. For example, the liquid need only be a material whose substance is in the liquid phase, and includes fluids such as an inorganic solvent, an organic solvent, a solution, a liquid resin, and a liquid metal (metal melt) in the form of a liquid body having a high or low viscosity, a sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink. Moreover, sublimation transfer ink can be used as the ink. Sublimation transfer ink is ink that includes a sublimation color material such as a sublimation dye. One example of a printing method is a method in which sublimation transfer ink is ejected onto a transfer medium by a liquid ejection device, a printing target is brought into contact with the transfer medium and heated to cause the color material to sublimate and be transferred to the printing target. The printing target is a T-shirt, a smartphone, or the like. In this way, if the ink includes a sublimation color material, printing can be performed on a diverse range of printing targets (printing media). Specific examples of the liquid ejection device include a liquid ejection device that ejects liquid including a material, such as an electrode material or a color material that is used for manufacturing a liquid crystal display, an EL (electro-luminescence) display, a surface emission display, or a color filter, for example, in the form of being dispersed or dissolved. The liquid ejection device may also be a liquid ejection device that ejects biological organic matter used in manufacturing of a biochip, a liquid ejection device that is used as a precision pipette and ejects a liquid serving as a sample, a textile printing apparatus, a microdispenser, or the like. Furthermore, the liquid ejection device may be a liquid ejection device that ejects lubricating oil in a pinpoint manner to a precision machine such as a watch or a camera, or a liquid ejection device that ejects, onto a substrate, transparent resin liquid such as UV-cured resin for forming, for example, a micro-hemispherical lens (optical lens) that is used in an optical communication element or the like. The liquid ejection device may also be a liquid ejection device that ejects acid or alkaline etchant, for example, for etching substrates or the like.

Note that the invention is not limited to the above embodiments and working examples, and can be achieved as various configurations without departing from the gist of the invention. For example, the technical features in the embodiments and working examples that correspond to the technical features in the modes described in the summary of the invention may be replaced or combined as appropriate in order to solve a part of, or the entire foregoing problem, or to achieve some or all of the above-described effects. The technical features that are not described as essential in the specification may be deleted as appropriate.

CROSS REFERENCE TO RELATED APPLICATIONS

The present application claims priority from Japanese Patent Application No. 2017-035976 filed on Feb. 28, 2017, the contents of which are hereby incorporated by reference into this application.

What is claimed is:

1. A printer comprising:

a printing head configured to eject ink;

a housing that houses the printing head;

a body cover configured to be shifted between a closed state of closing an opening formed in the housing and an open state of exposing the opening;

a tank including an ink container configured to contain the ink to be supplied to the printing head, and an ink inlet port through which the ink can be injected into the ink container; and a tank cover configured to be shifted between a closed state of closing the ink inlet port and an open state of exposing the ink inlet port, wherein the body cover and the tank cover are separate components, wherein, when the body cover in the closed state is viewed in plan view in a posture in which the printing head is used, the body cover covers a portion of the tank cover, and the ink inlet port is located outside a region of the body cover, and the tank cover changes from the closed state to the open state, triggered by the body cover changing from the closed state to the open state.

2. The printer according to claim 1, further comprising a cap member configured to be attached to and detached from the ink inlet port, wherein the cap member is configured to be switchable between a close off state of closing off the ink inlet port in a state of being attached to the ink inlet port and an open state of exposing the ink inlet port in a state of being removed from the ink inlet port, and the opening and closing of the tank cover and the attachment and detachment of the cap member relative to the ink inlet port are independent from each other.

3. The printer according to claim 1, wherein the state of the body cover is changed from the closed state to the open state as a result of the orientation relative to the housing being changed through pivoting thereof.

4. The printer according to claim 3, wherein the tank cover is changed from the closed state to the open state as a result of the orientation relative to the tank being changed through pivoting thereof, further including a link mechanism that transfers movement of the body cover to the tank cover.

5. The printer according to claim 3, wherein the tank cover is changed from the closed state to the open state as a result that the orientation relative to the tank is changed through pivoting thereof, and that the tank cover is biased toward the open state in an orientation in the closed state, and the tank cover is locked by the body cover when the tank cover is in the closed state and the body cover is in the closed state, and the locking of the tank cover by the body cover is released when the body cover is changed to the open state.

6. The printer according to claim 5, further comprising a biasing member that biases the tank cover toward the open state.

7. The printer according to claim 3, further comprising an actuator that causes the tank cover to change from the closed state to the open state.

8. The printer according to claim 1, wherein the state of the body cover is changed from the closed state to the open state as a result of the position relative to the housing being changed through sliding thereof.

9. The printer according to claim 8, wherein the tank cover changes from the closed state to the open state as a result of the position of the tank cover relative to the tank being changed through sliding thereof.

10. A printer comprising:

a printing head configured to eject ink;

a housing that houses the printing head;

a body cover configured to be shifted between a closed state of closing an opening formed in the housing and an open state of exposing the opening;

a tank including an ink container configured to contain the ink to be supplied to the printing head, and an ink inlet port through which the ink can be injected into the ink container; and a tank cover configured to be shifted between a closed state of closing the ink inlet port and an open state of exposing the ink inlet port, wherein, when the body cover in the closed state is viewed in plan view in a posture in which the printing head is used, the body cover covers a portion of the tank cover, and the ink inlet port is located outside a region of the body cover, and the tank cover changes from the closed state to the open state, triggered by the body cover changing from the closed state to the open state, wherein the tank cover includes a cap member connected therewith, the cap member closes off the ink inlet port when the tank cover is in the closed state, and exposes the ink inlet port when the tank cover is in the open state.

11. A printer comprising:

a printing head configured to eject ink;

a housing that houses the printing head;

a body cover configured to be shifted between a closed state of closing an opening formed in the housing and an open state of exposing the opening;

a tank including an ink container configured to contain the ink to be supplied to the printing head and an ink inlet port through which the ink can be injected into the ink container;

a tank cover configured to be shifted between a closed state of closing the ink inlet port and an open state of exposing the ink inlet port; and a cap member configured to be attached to and detached from the ink inlet port, wherein the cap member is configured to be switchable between a close off state of closing off the ink inlet port in a state of being attached to the ink inlet port and an open state of exposing the ink inlet port in a state of being removed from the ink inlet port, when the body cover in the closed state is viewed in plan view in a posture in which the printing head is used, the body cover covers a portion of the tank cover, and the ink inlet port is located outside a region of the body cover, and the cap member changes from the close off state to the open state, triggered by the tank cover changing from the closed state to the open state.

12. The printer according to claim 11, wherein the tank cover is changed from the closed state to the open state through pivoting thereof.

* * * * *